US008405700B2

(12) United States Patent
Koizumi et al.

(10) Patent No.: US 8,405,700 B2
(45) Date of Patent: Mar. 26, 2013

(54) EXPOSURE HEAD AND IMAGE FORMING APPARATUS WITH LIGHT EMITTING ELEMENT EMITTING LIGHT FORMING FIRST AND SECOND DIAGRAMS HAVING ANGLE

(75) Inventors: Ryuta Koizumi, Nagano (JP); Takeshi Sowa, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 13/074,647

(22) Filed: Mar. 29, 2011

(65) Prior Publication Data

US 2011/0242262 A1 Oct. 6, 2011

(30) Foreign Application Priority Data

Apr. 1, 2010 (JP) ..... 2010-085053

(51) Int. Cl.
*B41J 15/14* (2006.01)
*B41J 27/00* (2006.01)

(52) U.S. Cl. ..... 347/244; 347/258

(58) Field of Classification Search ..... 347/241, 347/244, 256, 258
See application file for complete search history.

(56) References Cited

U.S. PATENT DOCUMENTS

| | | | | |
|---|---|---|---|---|
| 7,889,222 | B2 * | 2/2011 | Koizumi et al. | 347/244 |
| 2005/0213222 | A1 * | 9/2005 | Kishima et al. | 359/668 |
| 2009/0195634 | A1 | 8/2009 | Koizumi et al. | |

FOREIGN PATENT DOCUMENTS

JP 2009-202579 A 9/2009

* cited by examiner

*Primary Examiner* — Hai C Pham
(74) *Attorney, Agent, or Firm* — Global IP Counselors, LLP

(57) ABSTRACT

An exposure head includes a light emitting element and a imaging optical system having a first region and a second region and contrived such that a slope of a long dimension of a spot diagram formed by light emitted from the light emitting element that passes through the first region is different from a slope of a long dimension of a spot diagram formed by light emitted from the light emitting element that passes through the second region.

5 Claims, 20 Drawing Sheets

$$x = r \cdot \cos(\theta) \quad \cdots \text{EQUATION 1}$$

$$y = r \cdot \sin(\theta) \quad \cdots \text{EQUATION 2}$$

$$\frac{Cv \cdot r^2}{1+\sqrt{1-(1+K)\cdot Cv^2 \cdot r^2}} + A \cdot x^2 + B \cdot y^2 + C \cdot x^4 + D \cdot x^2 \cdot y^2 + E \cdot y^4 + F \cdot x^6 + G \cdot x^4 \cdot y^2 + H \cdot x^2 \cdot y^4 + I \cdot y^6 \quad \cdots \text{EQUATION 3}$$

$$Cv = \frac{1}{R} \quad \cdots \text{EQUATION 4}$$

$$R = J + L \cdot \cos(M \cdot \theta) \quad \cdots \text{EQUATION 5}$$

EXPLANATIONS OF THE COMPONENTS OF THE EQUATIONS 1 TO 5

- x : coordinate along x axis (main scanning direction)
- y : coordinate along y axis (subordinate scanning direction)
- r : distance from lens center to point (x, y)
- $\theta$ : rotational angle about z-axis
- z : amount of sag of plane parallel to z-axis
- Cv : curvature of lens
- k : conic coefficient
- A~I : coefficient of monomial expressions $x^p y^q$
- R : radius of curvature of lens
- J : center value of radius of curvature
- L : amplitude of radius of curvature fluctuation
- M : period of radius of curvature fluctuation

Fig. 10

SPECIFICATIONS OF OPTICAL SYSTEM

| SPECIFICATION NAME | VALUE |
|---|---|
| WAVELENGTH | 690 nm |
| LENS EFFECTIVE DIAMETER | 1.56 mm |

Fig. 11

MIDDLE ROW LENS DATA UNIT: mm

| SURFACE NUMBER | SURFACE TYPE | SURFACE SPACING | INDEX OF REFRACTION |
|---|---|---|---|
| S1 (OBJECT SURFACE) | | 0.5 | $n_d$=1.517, $v_d$=64.2 |
| S2 | | 2.077 | |
| S3 (APERTURE SURFACE) | | 0.304 | |
| S4 | f (Θ) SURFACE | 0.33 | $n_d$=1.57, $v_d$=33.0 |
| S5 | | 0.5 | $n_d$=1.517, $v_d$=64.2 |
| S6 | | 1.190 | |
| S7 | x-y POLYNOMIAL SURFACE | 0.33 | $n_d$=1.57, $v_d$=33.0 |
| S8 | | 1 | $n_d$=1.517, $v_d$=64.2 |
| S9 | | 0.77 | |
| S10 (IMAGE SURFACE) | | | |

Fig. 12

S4 SURFACE DATA

| COEFFICIENT NAME | | VALUE |
|---|---|---|
| CONIC CONSTANT k | | -0.82640 |
| A | $x^2$ | 0.000000E+00 |
| B | $y^2$ | 8.299210E-03 |
| C | $x^4$ | -2.118461E-02 |
| D | $x^2y^2$ | -3.100223E-02 |
| E | $y^4$ | -2.029646E-02 |
| F | $x^6$ | -8.314379E-03 |
| G | $x^4y^2$ | -4.249529E-02 |
| H | $x^2y^4$ | -1.114638E-02 |
| I | $y^6$ | -6.508094E-03 |
| J | - | 1.211521E+00 |
| L | - | 4.846086E-03 |
| M | - | 8.000000E+00 |

Fig. 13

S7 SURFACE DATA

| COEFFICIENT NAME | | VALUE |
|---|---|---|
| CONIC CONSTANT k | | -0.99589 |
| A | $x^2$ | 0.000000E+00 |
| B | $y^2$ | -1.542234E-02 |
| C | $x^4$ | -2.869833E-02 |
| D | $x^2y^2$ | -9.750286E-02 |
| E | $y^4$ | -6.261696E-02 |
| F | $x^6$ | -6.033009E-02 |
| G | $x^4y^2$ | -1.931474E-01 |
| H | $x^2y^4$ | 2.271852E-01 |
| I | $y^6$ | 5.099176E-03 |
| J | - | 1.118353E+00 |
| L | - | 0 |
| M | - | 0 |

Fig. 14

SPECIFICATIONS OF OPTICAL SYSTEM

| SPECIFICATION NAME | VALUE |
|---|---|
| WAVELENGTH | 690 nm |
| LENS EFFECTIVE DIAMETER | 1.56 mm |

Fig. 15

MIDDLE ROW LENS DATA UNIT: mm

| SURFACE NUMBER | SURFACE TYPE | SURFACE SPACING | INDEX OF REFRACTION |
|---|---|---|---|
| S1 (OBJECT SURFACE) | | 0.5 | $n_d$=1.517, $v_d$=64.2 |
| S2 | | 2.077 | |
| S3 (APERTURE SURFACE) | | 0.304 | |
| S4 | f (θ) SURFACE | 0.33 | $n_d$=1.57, $v_d$=33.0 |
| S5 | | 0.5 | $n_d$=1.517, $v_d$=64.2 |
| S6 | | 1.190 | |
| S7 | x-y POLYNOMIAL SURFACE | 0.33 | $n_d$=1.57, $v_d$=33.0 |
| S8 | | 1 | $n_d$=1.517, $v_d$=64.2 |
| S9 | | 0.782 | |
| S10 (IMAGE SURFACE) | | | |

Fig. 16

S4 SURFACE DATA

| COEFFICIENT NAME | | VALUE |
|---|---|---|
| CONIC CONSTANT k | | -0.82288 |
| A | $x^2$ | 0.000000E+00 |
| B | $y^2$ | 2.008211E-02 |
| C | $x^4$ | -1.774125E-02 |
| D | $x^2y^2$ | -3.118638E-02 |
| E | $y^4$ | -2.008837E-02 |
| F | $x^6$ | -9.671742E-03 |
| G | $x^4y^2$ | -3.713150E-02 |
| H | $x^2y^4$ | -2.275327E-03 |
| I | $y^6$ | -8.213876E-03 |
| J | - | 1.244402E+00 |
| L | - | 4.977608E-03 |
| M | - | 8.000000E+00 |

Fig. 17

S7 SURFACE DATA

| COEFFICIENT NAME | | VALUE |
|---|---|---|
| CONIC CONSTANT k | | -1.00000 |
| A | $x^2$ | 0.000000E+00 |
| B | $y^2$ | -3.059314E-02 |
| C | $x^4$ | -2.344227E-02 |
| D | $x^2y^2$ | -8.197769E-02 |
| E | $y^4$ | -6.859002E-02 |
| F | $x^6$ | -4.897247E-02 |
| G | $x^4y^2$ | -2.009160E-01 |
| H | $x^2y^4$ | -2.430029E-01 |
| I | $y^6$ | 2.816655E-02 |
| J | - | 1.118910E+00 |
| L | - | 0 |
| M | - | 0 |

Fig. 18

$$r = \sqrt{x^2 + y^2} \quad \cdots \text{EQUATION 6}$$

$$z = \frac{Cv \cdot r^2}{1 + \sqrt{1 - (1 + K) \cdot Cv^2 \cdot r^2}} + A \cdot x^2 + B \cdot y^2 \quad \cdots \text{EQUATION 7}$$

EXPLANATIONS OF THE COMPONENTS OF THE EQUATIONS 1 TO 2

| | | |
|---|---|---|
| x | : | coordinate along x axis (main scanning direction) |
| y | : | coordinate along y axis (subordinate scanning direction) |
| r | : | distance from lens center to point (x, y) |
| Cv | : | curvature of lens |
| K | : | conic coefficient |
| A～B | : | coefficient of monomial expressions $x^p y^q$ |

Fig. 23

SPECIFICATIONS OF OPTICAL SYSTEM

| SPECIFICATION NAME | VALUE |
|---|---|
| WAVELENGTH | 780 nm |
| LENS EFFECTIVE DIAMETER | 0.15 |

Fig. 24

UNIT: mm

| SURFACE NUMBER | SURFACE TYPE | SURFACE SPACING | INDEX OF REFRACTION |
|---|---|---|---|
| S1 (OBJECT SURFACE) | | 4.000 | |
| S2 (APERTURE SURFACE) | | 0.200 | |
| S3 | REGION DEPENDENT | 1.5 | $n_d$=1.517, $v_d$=64.2 |
| S4 | CONIC | 2.055 | $n_d$=1.517, $v_d$=64.2 |
| S10 (IMAGE SURFACE) | | 0 | |

Fig. 25

S3
SURFACE DATA

Sf1
SURFACE SHAPE

| COEFFICIENT NAME | | VALUE |
|---|---|---|
| $C_V$ | | 0.7398 |
| K | | -1.6867 |
| A | $X^2$ | 0.0030 |
| B | $y^2$ | 0.0000 |

Fig. 26

S3
SURFACE DATA

Sf2
SURFACE SHAPE

| COEFFICIENT NAME | | VALUE |
|---|---|---|
| $C_V$ | | 0.7398 |
| K | | -1.6867 |
| A | $X^2$ | 0.0000 |
| B | $y^2$ | 0.0030 |

Fig. 27

S4
SURFACE DATA

| COEFFICIENT NAME | | VALUE |
|---|---|---|
| $C_V$ | | -0.6326 |
| K | | -3.2647 |
| A | $X^2$ | 0.0000 |
| B | $y^2$ | 0.0000 |

Fig. 28

EXPOSURE HEAD AND IMAGE FORMING APPARATUS WITH LIGHT EMITTING ELEMENT EMITTING LIGHT FORMING FIRST AND SECOND DIAGRAMS HAVING ANGLE

CROSS-REFERENCE TO RELATED APPLICATIONS

This application claims priority to Japanese Patent Application No. 2010-085053 filed on Apr. 1, 2010. The entire disclosure of Japanese Patent Application No. 2010-085053 is hereby incorporated herein by reference.

BACKGROUND

1. Technical Field

The present invention relates to an exposure head contrived to pass light from a light emitting element through an imaging optical system and shine it onto an exposure target surface.

2. Background Technology

In a known apparatus, a spot of light is shone onto an exposure target surface by focusing light emitted from a light emitting element with an imaging optical system. When exposing an exposure target surface with a light spot in this manner, it is appropriate for the size of the spot to be held generally within a certain range. However, if a focus position of the imaging optical system deviates from the exposure target surface, then the spot may become large and unfocused.

Therefore, the exposure head of the apparatus presented in Patent Document 1 has a plurality of different focus positions. In other words, the imaging optical system of the exposure head uses a lens having a plurality of regions having different focal lengths. Consequently, depending on the region where a given portion of light passes through the lens, the focus position varies along an optical axis direction of the imaging optical system. Thus, even if, for example, the distance between the exposure head and the exposure target surface changes such that one of the focus positions deviates from the exposure target surface, another focus position will become aligned with the exposure target surface and the size of the spot can be held within a prescribed range.

Japanese Patent Application Publication No. 2009-202579 (Patent Document 1) is an example of the related art.

SUMMARY

Problems to be Solved by the Invention

However, with the exposure head explained above, even though the size of the spot can be held within a prescribed range, the shape of the spot sometimes becomes anisotropic. More specifically, since the exposure head explained above is contrived to concentrate light (a light beam) at a plurality of different focus positions scattered along the optical axis direction, a comparatively isotropic spot is formed at each of the different focus positions. However, the spot becomes anisotropic at defocused positions lying between two focus positions. As a result, when the position of the exposure target surface fluctuates and the spot becomes defocused, there is a possibility that the spot shape will become anisotropic such that a good exposure cannot be achieved.

The invention was conceived in view of the anisotropy problem just explained and advantages of some aspects of the invention include providing a technology that can alleviate the anisotropy of the light spot and enable a good exposure to be achieved when the light spot is in a defocused state.

Means Used to Solve the Above-Mentioned Problems

In order to achieve the aforementioned advantages, an exposure head includes a light emitting element and an imaging optical system having a first region and a second region and contrived such that a slope of a long dimension of a spot diagram formed by light emitted from the light emitting element that passes through the first region is different from a slope of a long dimension of a spot diagram formed by light emitted from the light emitting element that passes through the second region.

In order to achieve the aforementioned advantages, an image forming apparatus includes an exposure head including a light emitting element and an imaging optical system having a first region and a second region and contrived such that a slope of a long dimension of a spot diagram formed by light emitted from the light emitting element that passes through the first region is different from a slope of a long dimension of a spot diagram formed by light emitted from the light emitting element that passes through the second region; and a latent image carrier on which a latent image is formed by light that has passed through the imaging optical system.

With the invention (this exposure head and image forming apparatus), the imaging optical system has a first region and a second region and is contrived such that a slope of a long dimension of a spot diagram formed by light passing through the first region is different from a slope of a long dimension of a spot diagram formed by light passing through the second region. Therefore, the spot ultimately formed is in accordance with a combination of the two spot diagrams. As a result, when the spot is in a defocused state, the anisotropy of the spot shape is alleviated and a good exposure can be achieved.

The exposure head is preferably contrived such that a long dimension of a spot diagram formed by light passing through the first region is perpendicular to a long dimension of a spot diagram formed by light passing through the second region. In this way, the anisotropy of the spot shape can be alleviated even more effectively.

In such a case, it is also acceptable to configure the exposure head such that the imaging optical system has a lens in which the first region and second region are arranged in an alternating fashion along a circumferential direction.

In order to achieve the aforementioned advantages, an optical head according to another embodiment of the invention includes a light emitting element and an imaging optical system having a lens and a substrate on which the lens is arranged. A radius of curvature R of the lens has the following relationship:

$$R=J+L\times\cos(M\times\theta)$$

where a Z axis is defined to be an imaginary axis that is parallel to a normal direction of the substrate and passes through a geometric center of gravity of a projection of the lens projected onto the substrate along a normal direction of the substrate, an X axis is defined to be an imaginary axis that is perpendicular to the Z axis and passes through the geometric center of gravity of the lens, J is a constant, L is a constant, M is a positive integer, and θ is a rotational angle with respect to the X axis measured in a counterclockwise direction about the Z axis.

The imaging optical system is contrived to focus light emitted from the light emitting element so as to form a spot diagram having a first long dimension and a stop diagram having a second long dimension with a different slope than the first long dimension.

In this embodiment of the invention (in this exposure head), the imaging optical system is contrived to focus light emitted from the light emitting element so as to form a spot diagram having a first long dimension and a stop diagram having a second long dimension with a different slope than the first long dimension. Therefore, the spot ultimately formed is in accordance with a combination of the spot diagrams. As a result, when the spot is in a defocused state, the anisotropy of the spot shape is alleviated and a good exposure can be achieved.

BRIEF DESCRIPTION OF THE DRAWINGS

FIG. 10 lists equations defining a shape of a lens surface based on lens data;

FIG. 11 is a table of a light wavelength and an effective diameter of a lens;

FIG. 12 shows lens data for an optical system;

FIG. 13 is a table of coefficients used to define a shape of an f(θ) surface of an optical system;

FIG. 14 is a table of coefficients used to define a shape of an x-y polynomial surface of an optical system;

FIG. 15 is a table of a light wavelength and an effective diameter of a lens;

FIG. 16 is lens data for an optical system;

FIG. 17 is a table of coefficients used to define a shape of an f(θ) surface of an optical system;

FIG. 18 is a table of coefficients used to define a shape of an x-y polynomial surface of an optical system;

FIG. 23 lists equations defining a shape of a lens surface based on lens data;

FIG. 24 is a table of a light wavelength and an effective diameter of a lens;

FIG. 25 is lens data for an imaging optical system;

FIG. 26 is a table of coefficients used to define a shape of a region of a lens;

FIG. 27 is a table of coefficients used to define a shape of a region of a lens;

FIG. 28 is a table of coefficients used to define a shape of a lens;

DETAILED DESCRIPTION OF EXEMPLARY EMBODIMENTS

First Embodiment

Figure 1:
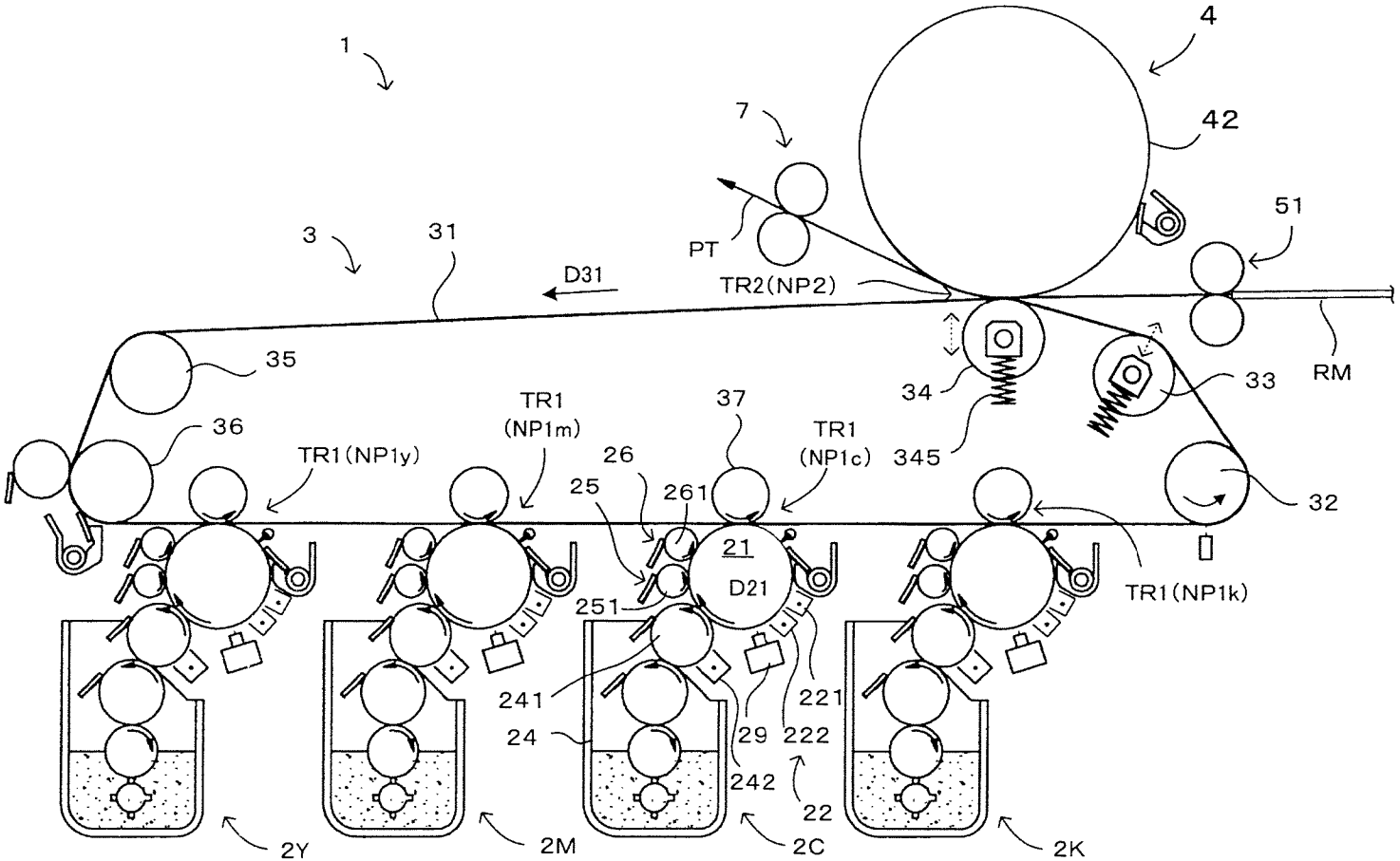
FIG. 1 shows an example of an image forming apparatus in which the invention can be employed.
Figure 2:
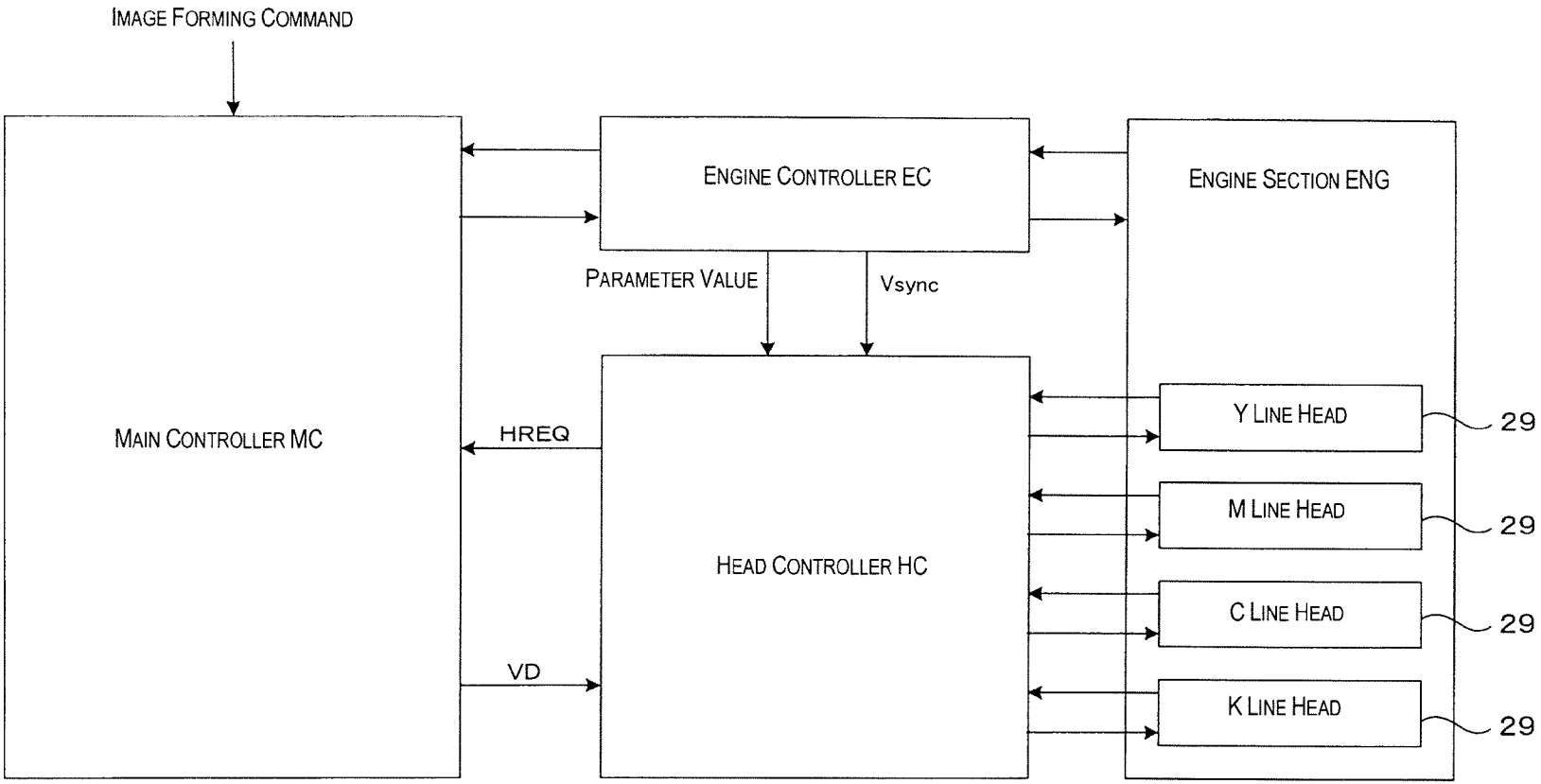
FIG. 2 is a block diagram of an electrical system of the apparatus shown in FIG. 1.

FIG. 1 shows an example of an image forming apparatus in which the invention can be employed. FIG. 2 is a block diagram of an electrical system of the apparatus shown in FIG. 1. The image forming apparatus 1 includes four image forming stations 2Y (for yellow), 2M (for magenta), 2C (for cyan), and 2K (for black), each contrived to form a different color image. The image forming apparatus 1 is contrived such that a color mode or a monochromatic mode can be selected. In the color mode a color image is formed using a combination of four color toners having the colors yellow (Y), magenta (M), cyan (C), and black (K), and in the monochromatic mode a mono chromatic image is formed using only the black (K) toner.

The image forming apparatus is contrived such that when a main controller MC having a CPU and a memory receives an image formation command from a host computer or other external device, the main controller MC sends a control signal to an engine controller EC and sends video data VD corresponding to the image formation command to a head controller HC. Each time it receives a horizontal request HREQ from the head computer HC, the main controller MC sends video data VD corresponding to one line in a main scanning direction MD of to the head controller HC. The head controller HC then controls line heads 29 of the image forming stations 2Y, 2M, 2C, and 2K corresponding to each of the colors based on the video data VD from the main controller MC and a vertical synchronization signal Vsync and parameter values from the engine controller EC. In this way, an engine section ENG executes a prescribed image forming operation in order to form an image corresponding to the image formation command on a recording medium RM having a sheet-like form, e.g., copy paper, transfer paper, form paper, or transparent sheets for and overhead projector.

Other than having different toner colors, each of the image forming stations 2Y, 2M, 2C, and 2K has the same structure and function. In FIG. 1, in order to make the drawing easier to read, only the image forming station 2C is shown with reference numerals assigned to each of its parts and the other image forming stations 2Y, 2M, and 2K are shown without reference numerals. Although the structure and operation of only the image forming station 2C are explained with reference to the reference numerals of FIG. 1 in the paragraphs that follow, the structure and operation of the other image forming stations 2Y, 2M, and 2K are the same and only the toner colors are different.

The image forming station 2C has a photoreceptor drum 21 contrived for a cyan toner image to be formed on a surface thereof. The photoreceptor drum 21 is arranged such that a rotational axis thereof is parallel or approximately parallel to the main scanning direction MD (direction perpendicular to the plane of the paper in FIG. 1) and contrived to be driven at a prescribed rotational speed in a direction indicated by an arrow D21 in FIG. 1. As a result, the surface of the photoreceptor drum 21 moves in a subordinate scanning direction SD that is perpendicular or approximately perpendicular to the main scanning direction MD.

In a surrounding vicinity of the photoreceptor drum 21, the following components are arranged in order as mentioned along the rotational direction D21 of the photoreceptor drum 21 (clockwise direction in FIG. 1): a corona-type charging device 22 contrived to charge the surface of the photoreceptor drum 21 to a prescribed electric charge, a line head 29 contrived to form an electrostatic latent image by exposing the surface of the photoreceptor drum 21 in accordance with an image signal, a developer device 24 contrived to develop the electrostatic latent image into a toner image, a first squeezing section 25, a second squeezing section 26, and a cleaning unit contrived to clean the surface of the photoreceptor drum 21 after an image is transferred.

In this embodiment, the charging device 22 includes two corona charging devices 221 and 222. The corona charging device 221 is arranged upstream of the corona charging device 222 with respect to the rotational direction D21 of the photoreceptor drum 21 and the two corona charging devices 221 and 222 serve to charge the photoreceptor drum 21 in two stages. Both of the corona charging devices 221 and 222 have the same constituent features and are scorotron charging devices contrived not to contact a surface of the photoreceptor drum 21.

After the surface of the photoreceptor drum 21 has been charged by the corona charging devices 221 and 222, the line head 29 forms an electrostatic latent image based on video data VD. That is, the head controller HC sends video data VD to the line head 29 and the light emitting element E emits light based on the video data VD. As a result, the surface of the photoreceptor drum 21 is exposed and an electrostatic latent image is formed which corresponds to the image signal. The constituent features and operation of the line head 29 will explained in more detail later.

The developing device 24 then applies toner to the electrostatic latent image and the electrostatic latent image is developed by the toner. The developing device 24 of this image forming device 1 has a development roller 241. The development roller 241 is a cylindrical member including a metal core made of iron or other metal and an elastic layer made of polyurethane rubber, silicon rubber, NBR, PFA tube, or other elastic material provided on an outer circumference of the metal core. The development roller 241 is connected to a development motor and driven in a counter clockwise direction from the perspective of FIG. 1 such that it co-rotates, non-opposing manner with respect to the photoreceptor drum 21. The development roller 241 is electrically connected to a development bias generator (constant voltage source) that is not shown in the figures, and the development bias generated is used to apply a development bias to the development roller 241 at an appropriate timing.

An anilox roller is provided to supply a liquid developing agent to the development roller 241. More specifically, a liquid developing agent is conveyed from a developing agent storage section to the development roller 241 through the anilox roller. In this way, the anilox roller functions to supply the liquid developing agent to the development roller 241. The anilox roller is a roller having a fine recessed pattern, e.g., a helical groove, that is engraved into a surface of the anilox roller in a uniform fashion and configured such that it can readily carry the liquid developing agent. Similarly to the development roller 241, the anilox roller includes a metal core having a urethane, NBR, or other rubber layer covering the metal core. The anilox roller is connected to and rotated by a development motor.

The liquid developing agent stored in the developing agent storage section is not a typically used volatile liquid developing agent that uses Isopar (trade name, made by Exxon) as a liquid carrier, has a low concentration (1 to 2 wt %) and a low viscosity, and is volatile at a room temperature. Instead, the liquid developing agent stored in the developing agent storage section is a high-concentration, high-viscosity liquid developing agent including solid particles in a liquid solvent along with an added dispersant. The solid particles have an average particle size of 1 μm and are made of a high-concentration, high-viscosity resin that is not volatile at room temperature and has a pigment or other colorant dispersed therein. The liquid solvent is an organic solvent, a silicon oil, a mineral oil, a cooking oil, or other liquid solvent. The liquid developing agent has an approximately 20% concentration of solid toner and a high viscosity (approximately 30 to 10000 mPa-s).

As explained previously, the development roller 241 rotates simultaneously with the anilox roller and receives a supply of liquid developing agent from the anilox roller. The development roller 241 also rotates in an opposite rotational direction as the photoreceptor drum 21 such that the surfaces of the development roller 241 and the photoreceptor drum 21 move in substantially the same direction in a vicinity where they contact each other. The liquid developing agent carried on the surface of the development roller 241 is delivered to a developing position. In order to form a toner image, it is necessary for the development roller 241 to co-rotate with the photoreceptor drum 21 such that the surfaces of the two rollers move in substantially the same direction at substantially the same speed, but such is not the case regarding the anilox roller. It is acceptable for the development roller 241 to move in either the same direction or the opposite direction with respect to the anilox roller.

Also, in this developing device 24, a toner compression corona generating device 242 is arranged facing the development roller 241 at a position immediately upstream of the developing position in the rotational direction of the development roller 241. The toner compression corona generating device 242 is electrically connected to a toner charge generator (not shown) including a constant current source and serves as an electric field applying member that increases a charge bias of the surface of the development roller 241. When a toner charge bias is applied to the toner compression corona generating device 242, an electric field is generated at a position where the toner compression corona generating device 242 is close to the toner of the liquid developing agent carried by the development roller 241. Thus, charging and compression of the toner occurs. Instead of charging and compressing the toner by using a corona discharge to generate an electric field, it is also acceptable to use a compaction roller to charge the toner while making contact.

This developing device 24 is also contrived such that it can move back and forth between a developing position where a latent image is developed on the photoreceptor drum 21 and an escape position separated from the photoreceptor drum 21. Therefore, when the developing device 24 is positioned at the escape position, the supply of new liquid developing agent to the photoreceptor drum 21 is stopped at the cyan image forming station 2C.

The first squeezing section 25 is arranged downstream of the developing position in the rotational direction D21 of the photoreceptor drum 21, and the second squeezing section 26 is arranged downstream of the first squeezing section 25. The squeezing section 25 is provided with a squeezing roller 251, and the squeezing section 26 is provided with a squeezing roller 261. The squeezing roller 251 touches against the surface of the photoreceptor drum 21 at a first squeezing position while being rotationally driven by a main motor, thereby removing excess liquid developing agent from the toner image. At a second squeezing position located downstream of the first squeeze position in the rotational direction D21 of the photoreceptor drum 21, the squeezing roller 261 touches against the surface of the photoreceptor drum 21 while being rotationally driven by the main motor, thereby removing excess liquid carrier and residual toner from the toner image. In this embodiment, in order to increase a squeezing efficiency, the squeeze rollers 251 and 261 are electrically connected to a squeeze bias generating section (constant voltage source, not shown) contrived to apply a squeeze bias at an appropriate timing. Although this embodiment has two squeezing sections 25 and 26, there are no particular limitations and the number and arrangement of squeezing sections. For example, it is acceptable to provide only one squeeze section.

After passing through the squeeze positions, the toner image undergoes a first transfer to an intermediate transfer body 31 of a transfer section 3. The intermediate transfer body 31 is an endless belt that is arranged on a plurality of rollers 32, 33, 34, 35, and 36 and serves as a image carrier contrived to carry a toner image temporarily on a surface, i.e., an outer circumferential surface, thereof. The roller 32 is connected to the main motor and functions as a belt driving roller driving the intermediate transfer body 31 such that it rotates in the direction of the arrow D31 shown in FIG. 1. In this embodiment, in order to achieve a closer contact between the recording paper RM and the surface of the intermediate transfer body 31 and improve a transfer performance of the toner image to the recording paper RM, an elastic layer is provided on the surface of the intermediate transfer body 31 and the toner image is carried on the surface of the elastic layer.

The belt driving roller 32 is the only roller among the rollers 32 to 36 carrying the intermediate transfer body 31 that is driven by the main motor; the other rollers 33 to 36 are idler rollers without a drive source. The belt driving roller 32 is arranged with the intermediate transfer body 31 wrapped across an outer circumference thereof and is positioned downstream of a primary transfer position TR1 and upstream of a secondary transfer position TR2 along the belt moving direction D31.

The transfer section 3 has a primary transfer backup roller 37 arranged such that the intermediate transfer body 31 is sandwiched between the primary transfer backup roller 37 and the photoreceptor drum 21. At the primary transfer position TR1, the outer circumferential surface of the photoreceptor drum 21 touches against the intermediate transfer body 31 so as to form a primary transfer nip NP1*c*. The toner image on the photoreceptor drum 21 is transferred to the outside surface of the intermediate transfer body 31 (bottom surface at the primary transfer position TR1). In this way, the cyan toner image formed by the image forming station 2C is transferred to the intermediate transfer body 31. The toner images of the other image forming stations 2Y, 2M, and 2K are transferred in the same manner such that the toner images of the different colors are layered over one another on the intermediate transfer body 31 in sequence, thereby forming a full color toner image. Conversely, when a monochromatic image is to be formed, a toner image is transferred to the intermediate transfer body 31 only at the image forming station 2K corresponding to the color black.

Next, the toner image transferred to the intermediate transfer body 31 passes by the belt driving roller 32 and reaches the secondary transfer position TR2. At the secondary transfer position, the intermediate transfer body 31 is sandwiched between the roller 34 and a secondary transfer roller 42 of a secondary transfer section 4 such that a secondary transfer nip NP2 is formed where the surface of the intermediate transfer body 31 and the surface of the transfer roller 42 contact each other. Thus, the roller 34 functions as a secondary transfer backup roller. A rotary shaft of the backup roller 34 is supported such that it can move freely toward and away from the intermediate transfer body 31 and is supported in an elastic fashion with a pressing section 345 including, for example, a spring or other elastic member.

At the secondary transfer position TR2, the single color or multiple color toner image formed on the intermediate transfer body 31 is transferred to a recording medium RM transported along a transport path PT from a pair of gate rollers 51. After receiving the secondary transfer of the toner image, the recording medium RM is conveyed from the secondary transfer roller 2 to a fixing unit 7 provided along the transport path PT. The fixing unit 7 applies heat, pressure, or other treatment to the toner image transferred to the recording medium RM to fix the toner image to the recording medium RM. In this way, a desired image can be formed on the recording medium RM.

Figure 3:
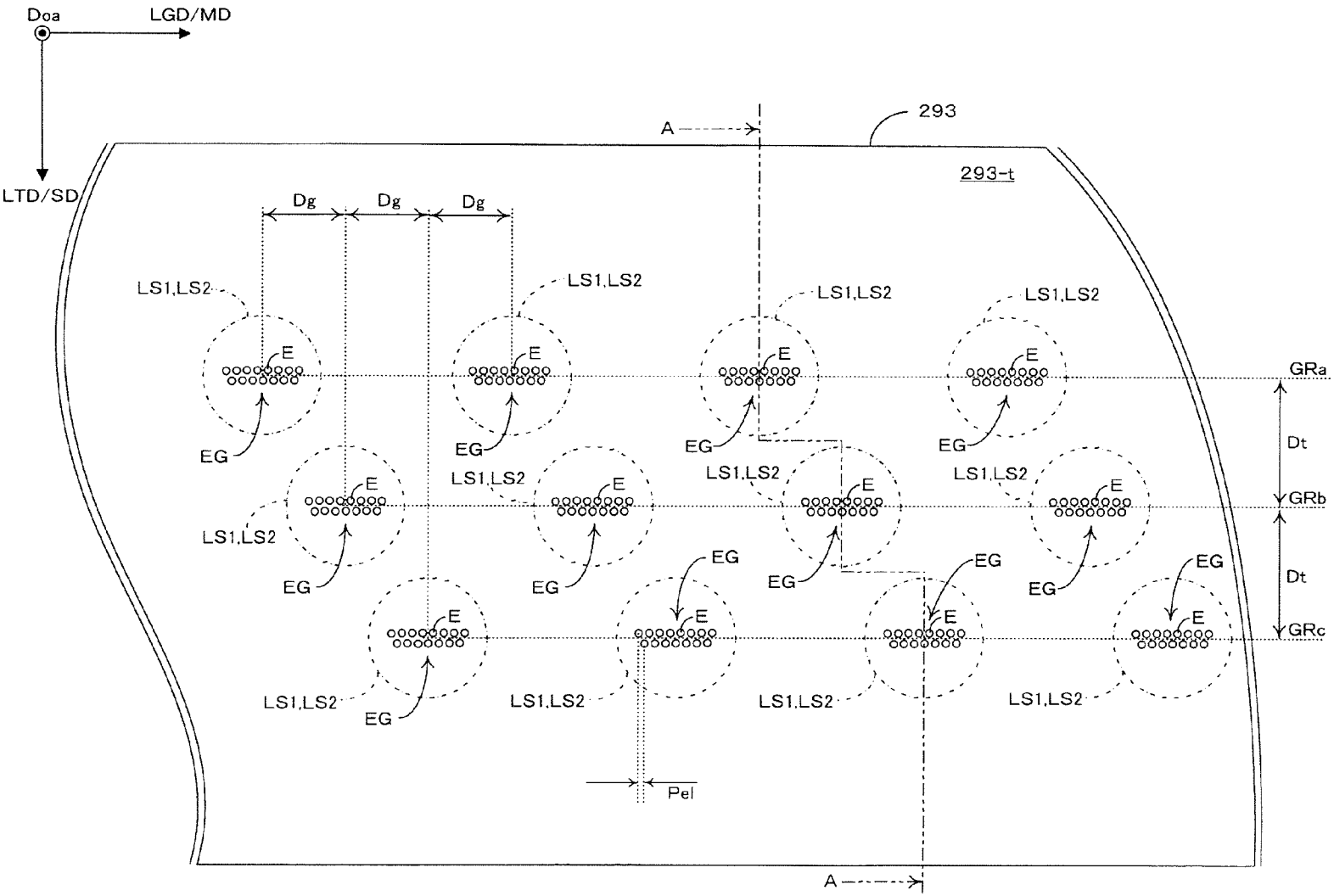
FIG. 3 shows an example of line head in which the invention can be employed.
Figure 4:
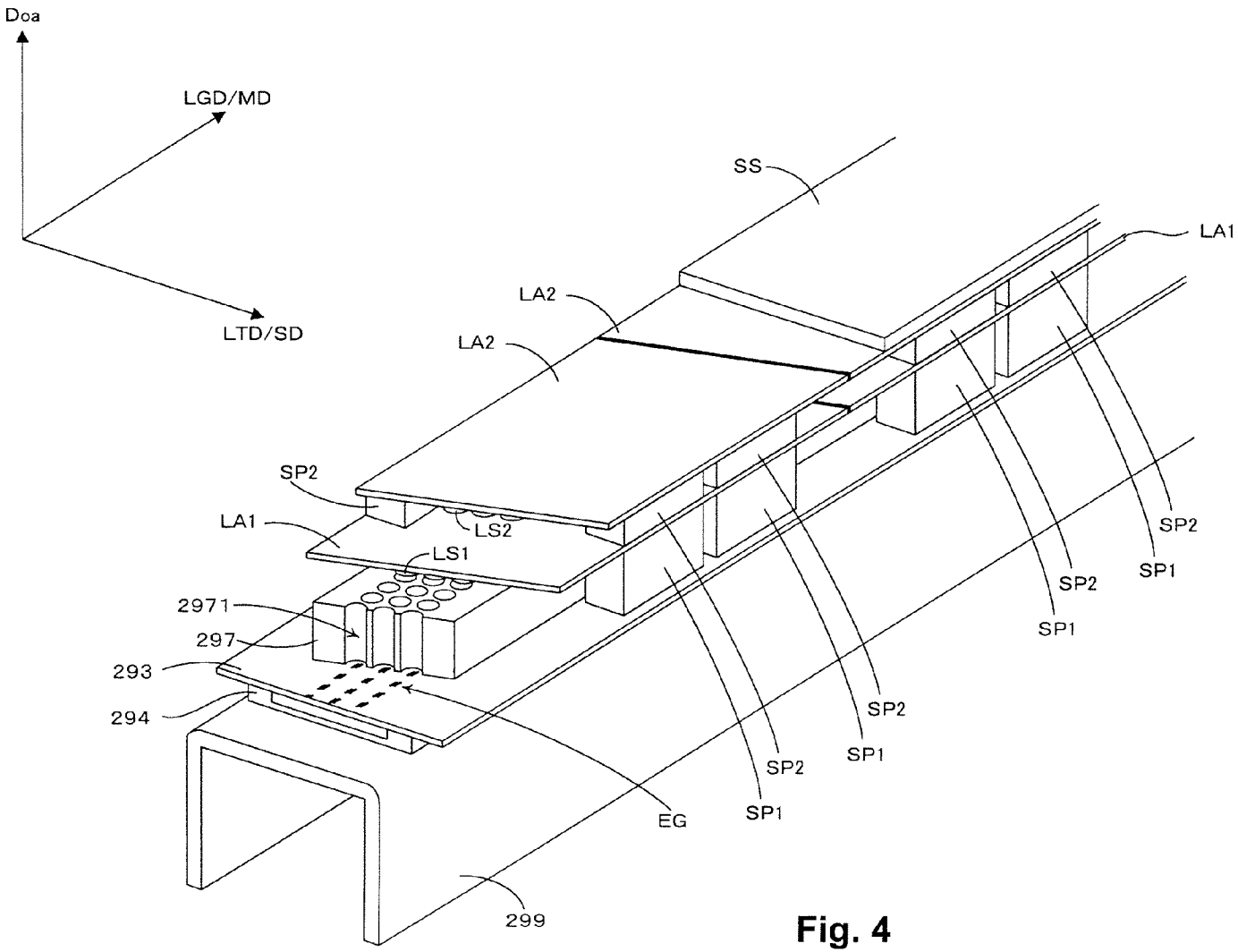
FIG. 4 shows an example of line head in which the invention can be employed.
Figure 5:
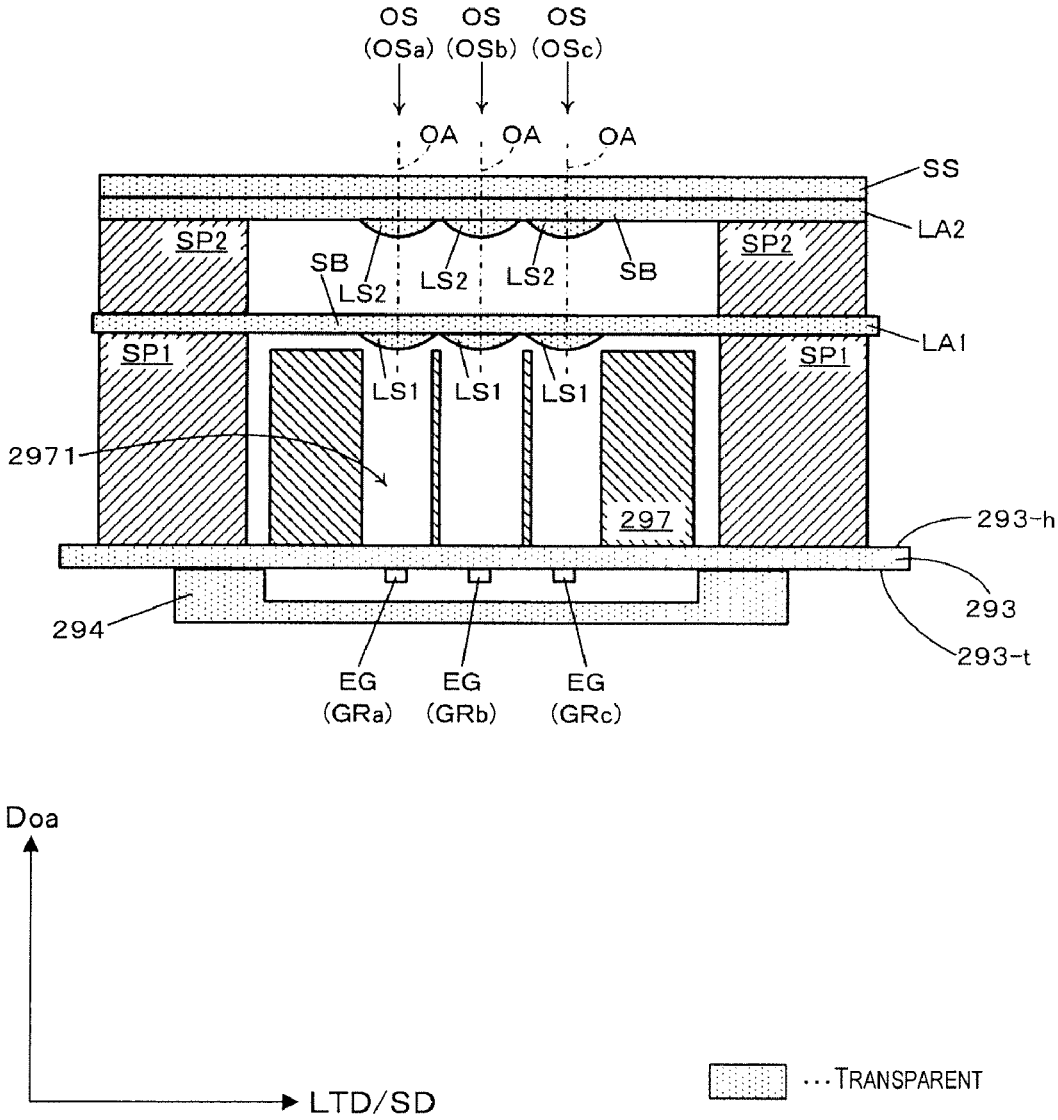
FIG. 5 shows an example of line head in which the invention can be employed.
Figure 6:
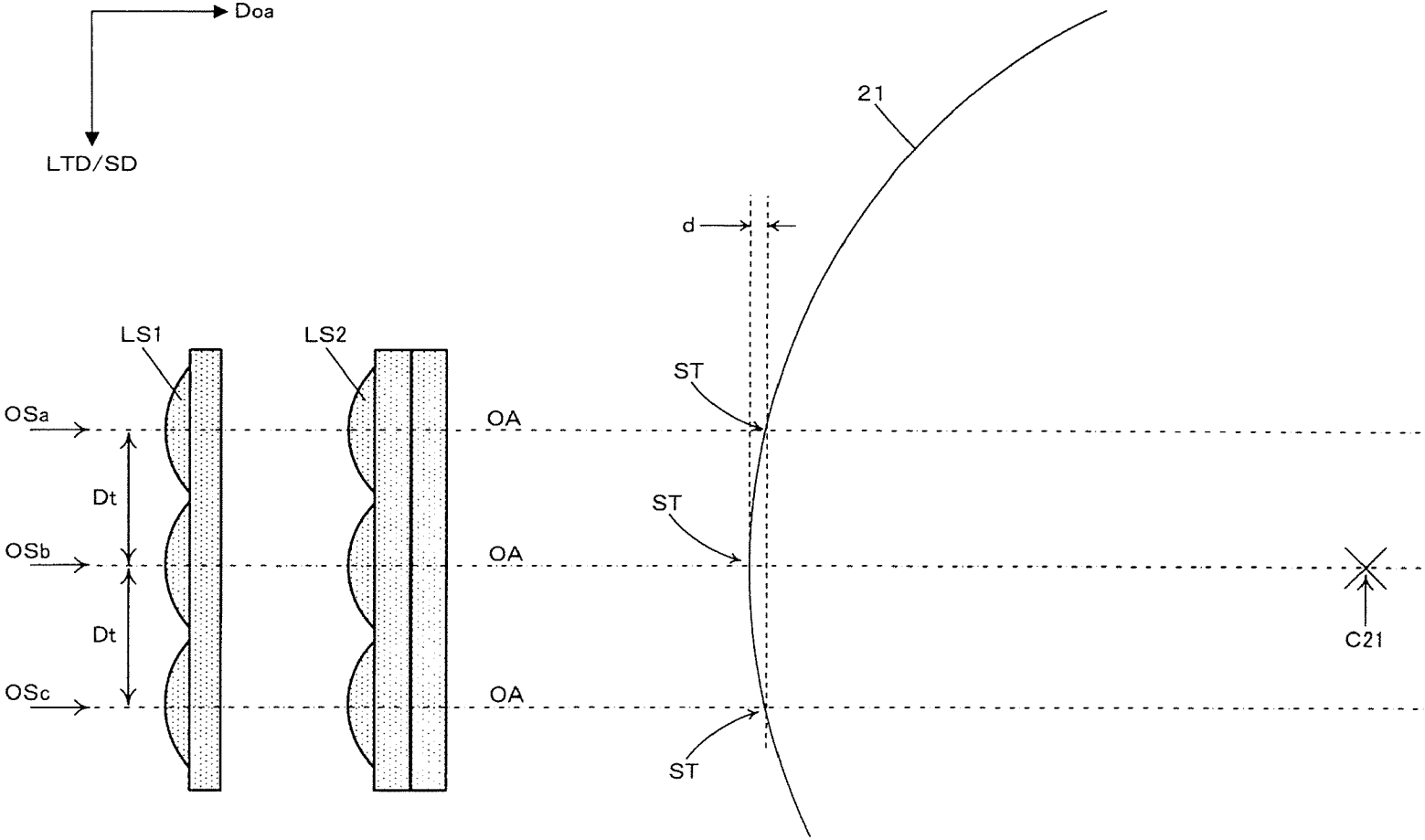
FIG. 6 shows a positional relationship among lenses forming an imaging optical system and a photoreceptor drum.

The preceding explanation provides an summary of the constituent features of the image forming apparatus. A line head 29 that can be used in an image forming apparatus according to this embodiment will now be explained in detail. FIGS. 3, 4, and 5 illustrate an example of a line head in which the invention can be applied. More specifically, FIG. 3 is a plan view showing a positional relationship of light emitting elements and lenses of the line head 29 as viewed from an optical axis direction Doa of an image optical system formed by the lenses; FIG. 4 is a partial perspective view of the line head 29; and FIG. 5 is a partial step-like cross sectional view of the line head 29 taken at a section line A-A (step-like double-dot chain line shown in FIG. 3) and viewed from a lengthwise direction LGD of the line head 29. In FIG. 3, the lenses LS1 and LS2 are depicted with a single-dot chain line to indicate that the light emitting elements E and the lenses LS1 and LS2 are arranged in different positions along the optical axis direction Doa. FIG. 6 shows a positional relationship among the lenses forming the imaging optical system and a photoreceptor drum.

The line head 29 is configured overall such that it is longer in a lengthwise direction LGD and shorter in a widthwise direction LTD. The lengthwise direction LGD and the widthwise direction LTD of the line head 29 are indicated as required in FIGS. 3 to 6 and subsequent figures mentioned below. The optical axis direction Doa of the optical axis of the imaging optical system formed by the lenses is also indicated in FIGS. 3 to 6 and subsequent figures as necessary. A positive optical axis direction Doa indicated with an arrow is expressed with such words as "front" and "upper," and a negative optical axis direction Doa oriented in the opposite direction as the arrow is expressed with such words as "back," "lower," and "bottom." The directions LGD, LTD, and Doa are perpendicular or approximately perpendicular to one another.

As mentioned previously, when such a line head 29 is employed in an image forming apparatus, the line head 29 serves to expose a surface of a photoreceptor drum 21 contrived to move in a subordinate scanning direction SD that is perpendicular or approximately perpendicular to a main scanning direction MD. Additionally, the main scan direction MD of the surface of the photoreceptor drum 21 is parallel or approximately parallel to the lengthwise direction LGD of the line head 29, and the subordinate scan direction SD of the surface of the photoreceptor drum 21 is parallel or approximately parallel to the widthwise direction LTD of the line head 29. Thus, as required, the main scan direction MD and the subordinate scan direction SD are indicated in the drawings along with the lengthwise direction LGD and the widthwise direction LTD.

In the line head 29, the light emitting elements E are arranged into a plurality of light emitting element groups EG. Each light emitting element group EG includes a plurality of (e.g., fifteen in FIG. 1) light emitting elements E arranged in two rows such that the light emitting elements E of one row are offset from the light emitting elements E of the other row. The light emitting element groups EG are arranged in three rows so as to be offset from one another along the lengthwise direction LGD. More specifically, the arrangement of the light emitting element groups EG can also be explained as follows. A light emitting element group EG is arranged with a pitch of three times a distance Dg along the lengthwise direction LGD and a plurality of light emitting element groups EG arranged in a linear fashion along the lengthwise direction LGD constitutes a light emitting element group row GRa. There are three light emitting element group rows GRa, GRb, and GRc arranged with a distance Dt in-between along the widthwise direction LTD and shifted relative to one another by the distance Dg in the lengthwise direction LGD.

The light emitting elements E are bottom emission type organic EL (electroluminescence) elements, all having the same light emission spectrum. Thus, the organic EL elements constituting the light emitting elements E are formed on a back surface 293-*t* of a head substrate 293 made of a flat glass plate that is longer in the lengthwise direction LGD and shorter in the widthwise direction LTD, and the organic EL elements are sealed by a glass sealing member 294. The sealing member 294 is fixed to the back surface 293-*t* of the head substrate 293 with an adhesive.

One imaging optical system OS is provided and aligned with respect to each of the light emitting element groups EG arranged as previously explained. More specifically, each of the imaging optical systems OS includes two lenses LS1 and LS2 that are convex on a side facing the light emitting element group EG. As shown in FIGS. 4 and 5, a light blocking member 297 is provided between the light emitting element groups EG and lenses LS1 and LS2. This material will be explained later after the imaging optical systems are explained.

In this line head 29, the lenses LS1 and LS2 are provided with respect to each of the light emitting element groups EG, which are arranged in three rows that are offset (shifted) from one another. Consequently, the lenses LS1 are arranged into a lens array LA1 including three rows that are offset from one another, and the lenses LS2 are arranged into a lens array LA2 including three rows that are offset from one another. More specifically, the lenses LS1 (LS2) of the lens array LA1 (LA2) are arranged at a pitch of three times a distance Dg along the lengthwise direction LGD, and a plurality of lenses LS1 (LS2) arranged in a linear fashion along the lengthwise direction LGD constitutes one row of lenses (one lens row). The three rows of lenses are arranged with a distance Dt in-between along the widthwise direction LTD and shifted relative to one another by the distance Dg in the lengthwise direction LGD.

The lens array LA1 (or LA2) can be made by forming resin lenses LS1 (or LS2) on a substantially transparent flat glass plate SB. In this embodiment, since it is difficult to fabricate a lens array that is long in the lengthwise direction LGD as a one piece integral unit, a plurality of shorter lens arrays LA1 (LA2) are fabricated by forming resin lenses LS1 (LS2) in three offset rows on a comparatively short flat glass plates and arranging the short lens arrays LA1 (LA2) side by side in the lengthwise direction LGD to form a lens array that is long in the lengthwise direction LGD.

More specifically, a plurality of spacers SP1 arranged in a linear fashion along the lengthwise direction LGD with spaces in-between is provided on each of both widthwise edge portions of a head substrate surface 293-*h* such that the plurality of spacers SP1 are separated from each other along the widthwise direction LTD. The lens arrays LA2 are arranged to span across opposing spacers SP1 and SP1 in the widthwise direction LTD such that the lens arrays LA1 are aligned side by side in the lengthwise direction LGD to form one long lens array. Additionally, plurality of spacers SP2 arranged in a linear fashion along the lengthwise direction LGD with spaces in-between is provided on each of both widthwise edge portions of a surface of the long lens array made up of the lens arrays LA1 such that the plurality of spacers SP2 are separated from each other along the widthwise direction LTD. The lens arrays LA2 are arranged to span across opposing spacers SP2 and SP2 in the widthwise direction LTD such that the lens arrays LA2 are aligned side by side in the lengthwise direction LGD to form one long lens array. A flat plate-like support glass SS is attached to a surface of the long lens array formed by the lens arrays LA2 with an adhesive such that the lens arrays LA2 are supported by both the spacers SP2 and the support glass SS on the opposite side as the spacers SP2. The support glass SS also serves to cover the lens arrays LS2 such that the lens arrays LA2 are not exposed to the outside surroundings.

Thus, the two lens arrays LA1 and LA2 are arranged substantially parallel to the head substrate 293 such that the pairs of lenses LS1 and LS2 form imaging optical systems OS that are arranged in three rows offset from each other in the lengthwise direction LGD in positions corresponding to the three offset rows of light emitting element groups EG. Light emitted from the light emitting elements E of a light emitting element group EG passes through the imaging optical system OS and the support glass SS and is shone onto a surface of the photoreceptor drum 21. In FIG. 5, an imaging optical system OS serving to focus light from a light emitting element group EG of the light emitting element group row GRa is indicated with the reference symbol OSa. Similarly, imaging optical systems OS serving to focus light from light emitting element groups EG of the light emitting element group rows GRb and GRc are indicated with the reference symbol OSb and OSc, respectively. Thus, imaging optical systems OS arranged in different positions with respect to the widthwise direction LTD are indicated with different reference symbols OSa, OSb, and OSc.

Thus, in this line head 29, a dedicated imaging optical system OS is provided with respect to each of the light emitting element groups EG. In such a line head 29, it is preferable if light from any given light emitting element group EG only passes through the imaging optical system OS provided with respect to that light emitting element group EG and does not pass through any of the other imaging optical systems OS. Therefore, a light blocking member 297 is provided between the surface 293-*h* of the head substrate 293 and the lens array LA1. The light blocking member 297 functions to restrict light heading from a light emitting element group EG toward the imaging optical system OS corresponding to the same light emitting element group EG. More specifically, the light blocking member 297 is configured to have light passage holes 2971 that lead from the light emitting element groups EG to the corresponding imaging optical systems OS along the optical axis direction Doa. The light passage holes 2971 are cylinder shaped and a center axis of each light passage hole 2971 coincides with the optical axis OA of the corresponding imaging optical axis OS. Thus, a portion of the light emitted from a light emitting element group EG that passes through the light passage hole 2971 without being blocked by a bottom surface of the light blocking member 297 enters the imaging optical system OS. The light focused by the imaging optical system OS is shone onto the surface of the photoreceptor drum 21 as a spot ST, thereby exposing the surface of the photoreceptor drum 21 (FIG. 6).

As explained above, in this embodiment, the imaging optical systems OSa, OSb, and OSc are arranged in different positions along the widthwise direction LTD. The imaging optical systems OSa, OSb, and OSc are arranged with the same pitch Dt in the widthwise direction LTD, and the optical axes OA of the middle imaging optical systems OSb are arranged to pass through a center of center C21 of the photoreceptor drum 21. Thus, the positions where the spots ST formed by the imaging optical systems OSb located in the middle with respect to the widthwise direction LTD and the positions where the spots ST formed by the outer imaging optical systems OSa and OSc located on either end with respect to the widthwise direction LTD are offset from each other by a distance D along the optical axis direction Doa (FIG. 6).

In this embodiment, the optical characteristics of the imaging optical systems OS are such that the imaging optical systems OS have a plurality of different astigmatisms and long dimensions of the spot diagrams (focal line) formed by the different astigmatisms are diagonal with respect to one another. Thus, a spot ST formed by an imaging optical system OS under defocused conditions will have a shape in accordance with a combination of the spot diagrams (blur ellipses) whose long dimensions are diagonal with respect to one another.

Figure 7:
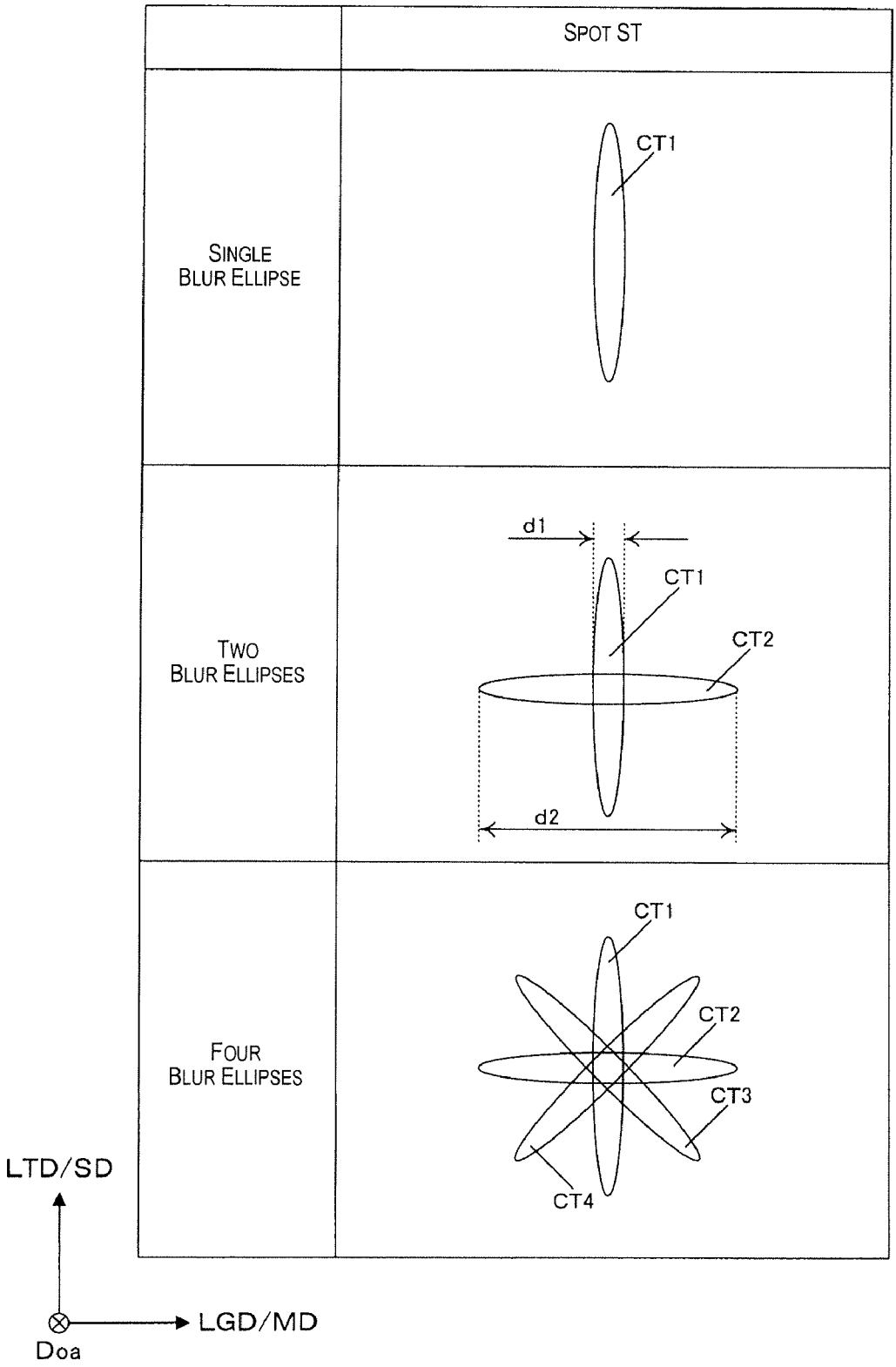
FIG. 7 shows simple sketches for explaining modes of forming a light spot in accordance with a first embodiment.

FIG. 7 shows simple sketches for explaining modes of forming a light spot in accordance with a first embodiment. In the same figure, the sketch titled "single blur ellipse" is provided for comparison and the sketches titled "two blur ellipses" and "four blur ellipses" are for explaining spot formation modes that are in accordance with this embodiment. The spot ST titled "single blur ellipse" includes only one blur ellipse CT1 (spot diagram) that extends in the subordinate scanning direction SD. As a result, this spot ST is anisotropic in that it is long in the subordinate scanning direction and short in the main scanning direction MD. Conversely, the spot ST titled "two blur ellipses" includes two blur ellipses CT1 and CT2 that intersect each other perpendicularly (two spot diagrams CT1 and CT2 whose long dimensions intersect each other perpendicularly) and the anisotropy of the previously explained spot ST is alleviated. Additionally, the spot ST titled "four blur ellipses" includes four blur ellipses (spot diagrams) CT1 to CT4 that intersect each other diagonally at 45-degree angles so as to achieve a shape that is closer to a circular shape. As a result, the spot ST including four blur ellipses alleviates the anisotropy of the previously explained spot ST to an even greater degree. Thus, one can see that the anisotropy of the shape of a spot ST can be alleviated by forming the spot ST as a combination of a plurality of spot diagrams whose long dimensions are diagonal with respect to one another.

As explained above, the optical characteristics of the imaging optical systems OS are such that the imaging optical systems OS have a plurality of different astigmatisms and long dimensions of the spot diagrams (blur ellipses) formed by the different astigmatisms are diagonal with respect to each other. Consequently, the spots ST formed with the imaging optical systems OS have a shape that results from a plurality of spot diagrams (blur ellipses) combined such that the long dimensions of the spot diagrams are diagonal with respect to one another. As a result, when the spot ST is in a defocused state, the anisotropy of the spot shape is alleviated and a good exposure can be achieved.

Additionally, a particular effect is obtained when a spot ST is formed by combining two spot diagrams (e.g., CT1 and CT2 or CT3 and CT4) such that the long dimensions are diagonal at right angles with respect to each other as in the spot including two blur ellipses and the spot including four blur ellipses shown in FIG. 7. Namely, since the short dimension of one spot diagram intersects the long dimension of the other spot diagram at a right angle (in the figure, the short dimension d1 of the spot diagram CT1 intersects the long dimension d2 of the spot diagram CT2), the anisotropy of the spot shape can be alleviated even more effectively.

Here ends the explanation of the first embodiment of the invention. Other embodiments of the invention will now be explained in detail.

Second Embodiment

Figure 8:
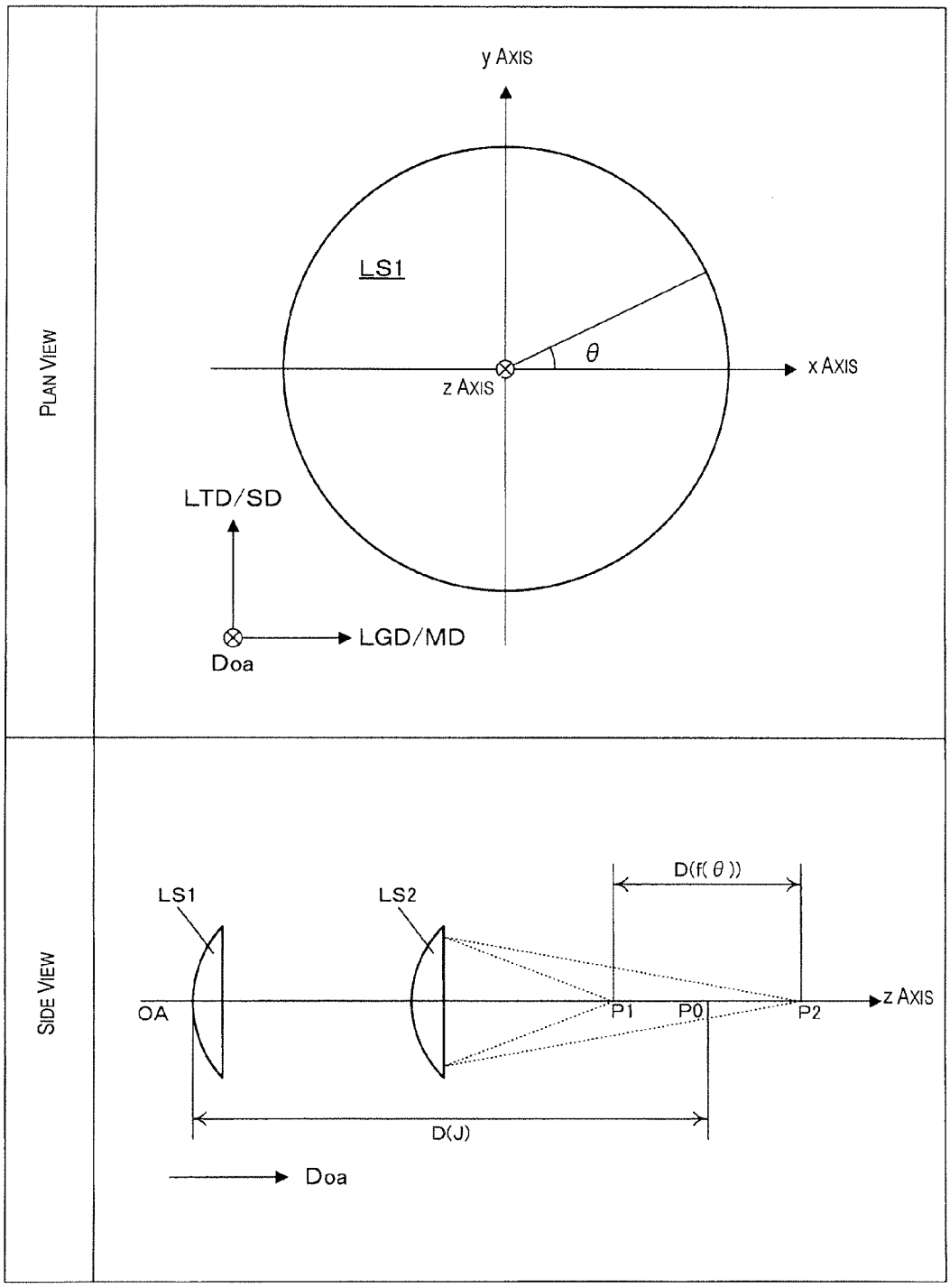
FIG. 8 shows simple sketches illustrating constituent features of a lens LS1 of an imaging optical system according to a second embodiment.

FIG. 8 shows simple sketches illustrating constituent features of a lens LS1 of an imaging optical system according to a second embodiment. In upper sketch titled "plan view" is a plan view of the lens LS1 as seen from the light emitting element E side along the optical axis direction Doa, and the lower sketch titled "side view" shows the imaging optical system OS as seen from a direction perpendicular to the optical axis direction Doa. In FIG. 7, a Z axis is defined to be an imaginary axis that is parallel to a normal direction of a flat glass plate SB forming a lens array LA1 and passes through a geometric center of gravity of a projection of the lens LS1 projected onto (a far surface of) the flat glass plate SB along the normal direction of the flat glass plate SB (in this embodiment, the Z axis coincides with the optical axis OA), an X axis is defined to be an imaginary axis that is perpendicular to the Z axis and passes through the geometric center of gravity of the lens LS1 (in this embodiment, the X axis coincides with the main scanning direction MD), and a Y axis is defined to be an imaginary axis that is perpendicular to the Z axis and the X axis and passes through the geometric center of gravity of the lens LS1 (in this embodiment, the Y axis coincides with the subordinate scanning direction SD).

If θ ($-\pi \leqq \theta \leqq \pi$) is a rotational angle with respect to the X axis measured counter clockwise about the Z axis, then a radius of curvature R of the lens LS1 (lens surface) can be expressed with the following relationship.

$$R=J+f(\theta)$$

In the equation above, J is a constant and f(θ) is a function having θ as a variable. In the second embodiment, the function f(θ) is a cosine function expressed as follows:

$$f(\theta)=L\times\cos(M\times\theta)$$

Here, L is a constant and M is a positive integer. In this patent specification, the angle θ is expressed in units of radians (rad).

When the lens LS1 has the constituent features just explained, an imaging position of the imaging optical system OS is distributed in a continuous fashion in a range spanning from a position P1 to a position P2 and having a position P0 as an approximate center position. A distance D(J) between the lens LS1 and the position P0 is determined based on the aforementioned constant J. Thus, an approximate center of the distribution range of the imaging position can be set by adjusting the constant J. The distribution range D(f(θ)) of the imaging position is determined by the function f(θ). Thus, the distribution range D(f(θ)) of the imaging position can be set by adjusting the function f(θ).

By varying the radius of curvature R of the lens LS1 with respect to the angle θ, a plurality of astigmatisms can be imparted to the lens and, thus, the blur ellipses formed by the different astigmatisms can be made to be diagonal with respect to one another. In other words, the optical characteristics of the imaging optical systems OS can be contrived such that the long dimensions of the spot diagrams (blur ellipses) formed by the astigmatisms are diagonal with respect to one another. The optical characteristics will now be explained using more detailed data related to the imaging optical system OS.

Figure 9:
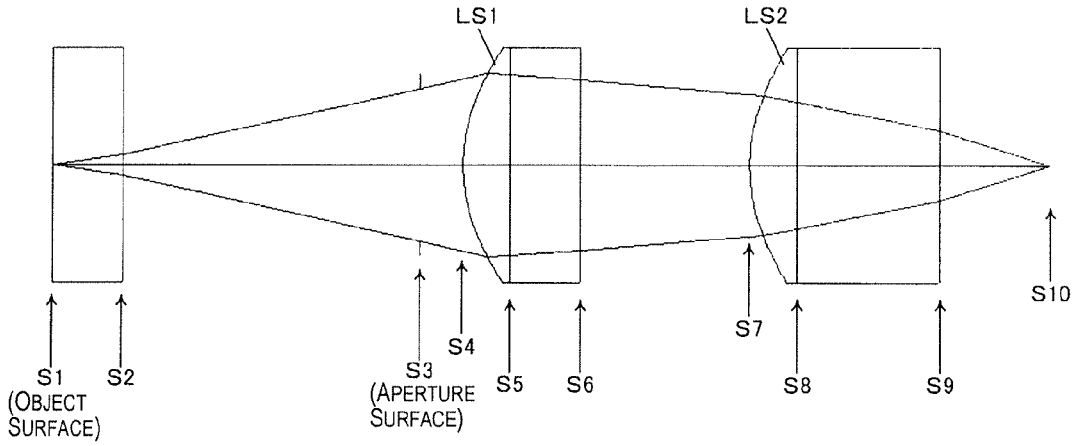
FIG. 9 is a ray diagram of an imaging optical system in a cross section in a main scanning direction.

FIG. 9 is a ray diagram of an imaging optical system in a cross section viewed along a main scanning direction. FIG. 10 lists equations defining a shape of a lens surface based on lens data. The equation 1 and the equation 2 serve to establish the correspondence between x-y Cartesian coordinates and r-θ polar coordinates. The equation 3 is serves to define the shape of the lens surface (x-y polynomial surface) of the lens LS2 or the shape of the lens surface (f(θ) surface) of the lens LS1. More specifically, if the curvature Cv of a lens given by the equation 4 (Cv=1/R) is assumed to be a constant value, then the equation 3 will give the shape of the lens surface (x-y polynomial surface) of the lens LS2. Meanwhile, if the radius of curvature R is assumed to be a function of the angle θ as shown in FIG. 5 and, accordingly, the curvature Cv (=1/R) is also expressed as a function of the angle θ, then the equation 3 will give the shape of the lens surface (f(θ) surface) of the lens LS1. The meanings of the other coefficients A to I, etc., used in the equations are as explained in FIG. 10.

FIG. 11 is a table showing a wavelength of light passing through a middle optical system OSb and an effective diameter of the lenses LS1 and LS2. FIG. 12 shows lens data for the middle optical system OSb. FIG. 13 is a table showing coefficients defining the shape of the f(θ) surface of the middle optical system OSb, i.e., the surface S4. FIG. 14 is a table showing coefficients defining the shape of the x-y polynomial surface of the middle optical system OSb, i.e., the surface S7. FIG. 15 is a table showing a wavelength of light passing through an outer optical system OSa or OSc and an effective diameter of the lenses LS1 and LS2. FIG. 16 shows lens data for the outer optical system OSa or OSc. FIG. 17 is a table showing coefficients defining the shape of the f(θ) surface of the outer optical system OSa or OSc, i.e., the surface S4. FIG. 18 is a table showing coefficients defining the shape of the x-y polynomial surface of the outer optical system OSa or OSc, i.e., the surface S7.

As can be seen in the drawings, this embodiment includes a limiting aperture (aperture surface S3) provided between the light emitting element (object surface S1) and the lens LS1 (f(θ) surface S4). Light that has passed through the limiting aperture passes through the lens LS1 and the lens LS2 and strikes an image surface S10. It is good to form the limiting aperture inside the light passage hole 2971 of the light blocking member 297 shown in FIG. 5.

In this embodiment, a radius of curvature R of the lens LS1 is given by the following equation.

$$R=J+L\times\cos(M\times\theta)$$

Figure 19:
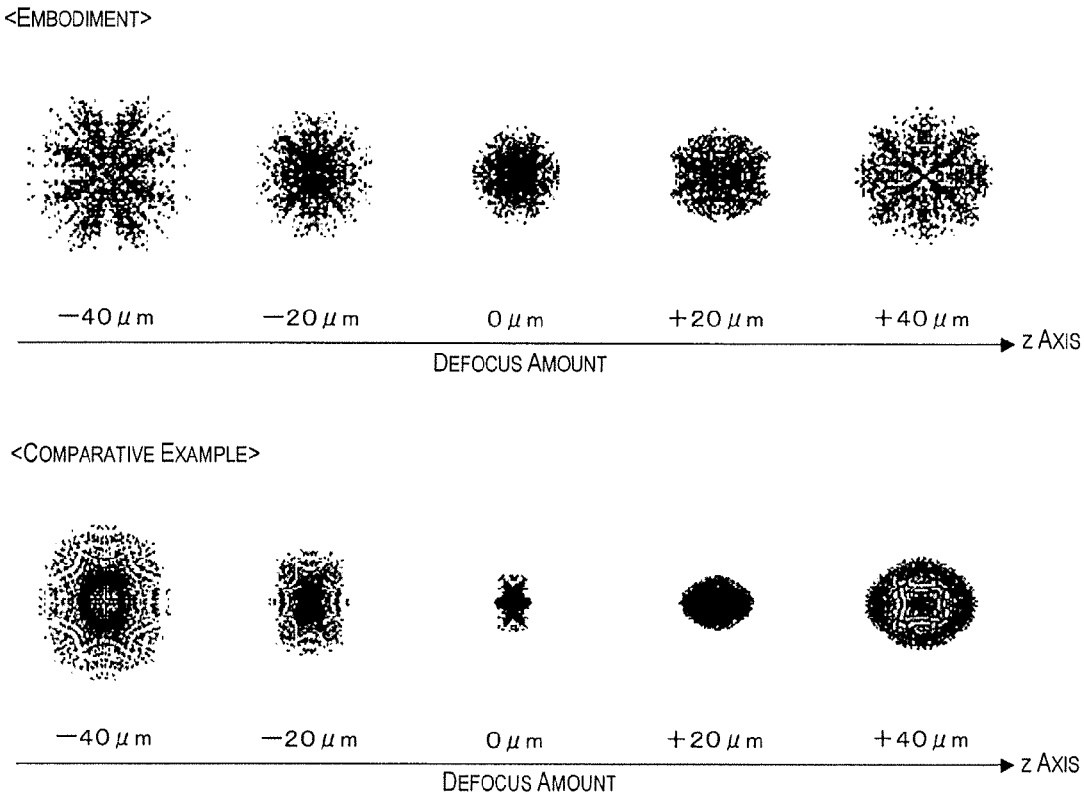
FIG. 19 shows spot diagrams obtained with an embodiment and with a comparative example.

Thus, the radius of curvature R changes in a continuous fashion with respect to the angle θ in accordance with the cosine function cos(M×θ). As a result, the lens LS1 has a plurality of astigmatisms and, thus, the optical characteristics of the imaging optical systems OS can be contrived such that the long dimensions of the spot diagrams (blur ellipses) formed by the astigmatisms are diagonal with respect to one another. As shown in FIG. 19, the spot ST includes a combination of the different spot diagrams (blur ellipses) arranged such that the long dimensions are diagonal with respect to one another and the anisotropy of the shape of the spot ST can be alleviated.

FIG. 19 shows spot diagrams obtained with this embodiment and spot diagrams obtained with a comparative example at different defocus amounts ranging from −40 μm to +40 μm. In FIG. 19, it is assumed that the position P0 shown in FIG. 8 is the position where the defocus amount is 0 μm. The spot diagrams titled "embodiment" and shown in an upper portion of the figure are obtained based on the lens data explained previously. The spot diagrams titled "embodiment" and shown in an upper portion of the figure are calculated based on lens data presented in Patent Document 1. In the comparative example, the spot ST exhibits vertically elongated anisotropy in a range of negative defocus amounts and horizontally elongated anisotropy in a range of positive defocus amounts. Conversely, in the embodiment, the spot ST includes a combination of a plurality of spot diagrams (blur ellipses) arranged such that their long dimensions are diagonal with respect to one another. As a result, as can be observed in the figure, the anisotropy occurring in a defocused state is alleviated.

Third Embodiment

Figure 20:
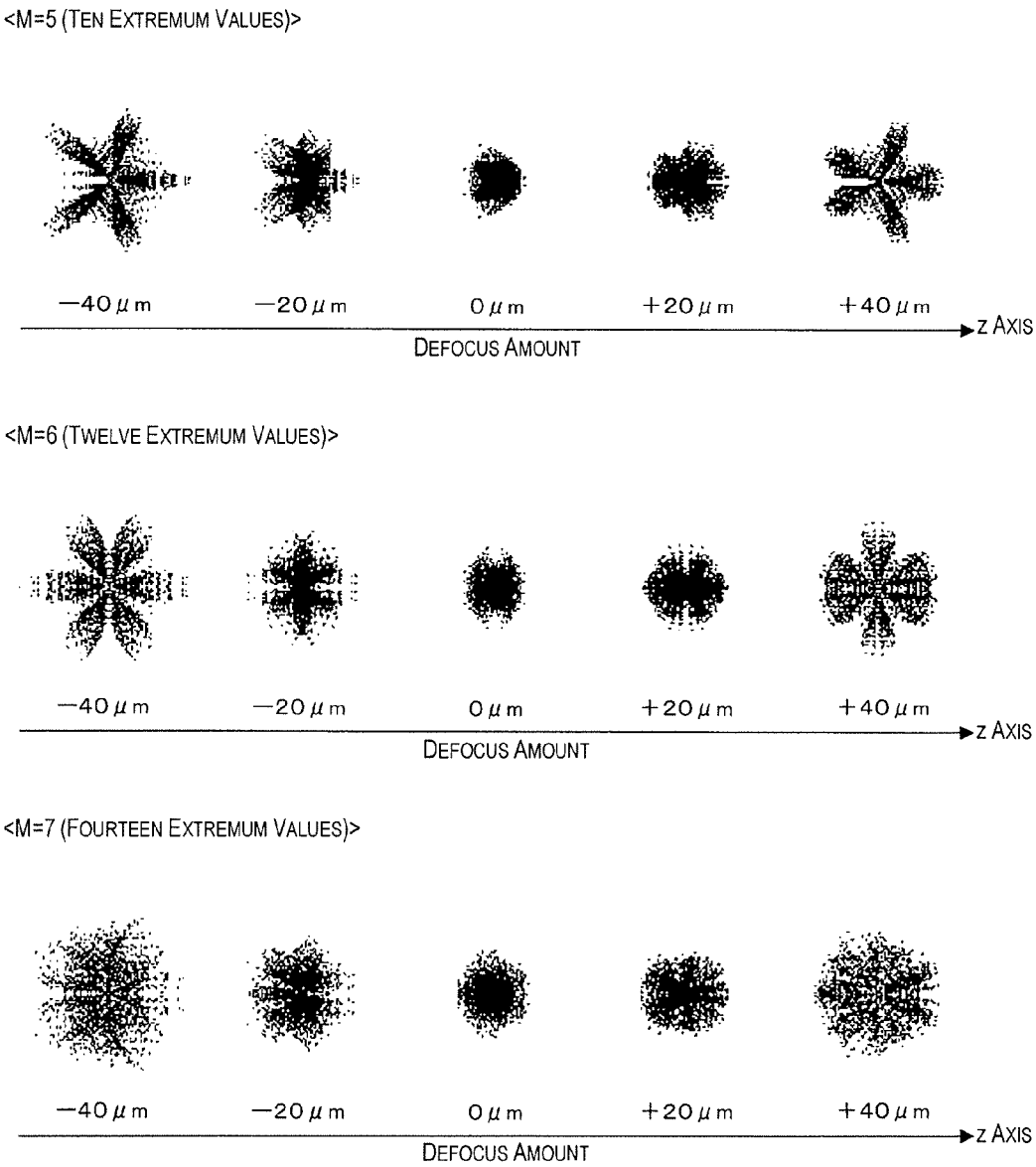
FIG. 20 shows spot diagrams obtained when a value M (which determines a function period) is varied.

In a third embodiment, a relationship between the spot ST and a change period of the curvature of the lenses presented in the second embodiment will be explained. FIG. 20 shows spot diagrams obtained when the value M is varied from 5 to 7. At each value of M, the defocus amount is varied from −40 μm to 40 μm. The period of the cosine function is determined based on the value M. In FIG. 20, it is assumed that the position P0 shown in FIG. 8 is the position where the defocus amount is 0 μm. In the third embodiment, a relationship between the value M and the spot diagram will be explained with reference to FIG. 20.

The lens LS1 has a curvature in both a meridian direction and in a sagittal direction. Thus, the spot diagram obtained at the image surface exhibits a periodic variation (increasing and decreasing) of quantity of light in a circumferential direction of the lens LS1. More specifically, as shown in FIG. 20, portions where the quantity of light is smaller and portions where the quantity of light is larger are arranged adjacent to one another in an alternating fashion along a circumferential direction of the lens such that the quantity of light varies between two extremum values (corresponding to the extrema of the radius of curvature) within the span of any two adjacent portions.

As can be observed in the figure, regardless of which M value is used, the anisotropy of a defocused spot ST is alleviated because the spot ST includes a combination of a plurality of spot diagrams (blur ellipses) arranged diagonally with respect to one another. Furthermore, the anisotropy exhibits a trend of being further alleviated as the M value increases. Particularly in a range of M values equal to or larger than 6, the degree of anisotropy is small and a substantially isotropic spot ST can be formed.

Fourth Embodiment

In the third embodiment, the radius of curvature of the lens surface is varied in accordance with the angle θ in a continuous fashion to obtain such an optical characteristic that the spot ST includes a plurality of spot diagrams (blur ellipses) combined such that the long dimensions thereof are diagonal with respect to one another. Conversely, in the fourth embodiment, a similar optical characteristic is obtained by forming a lens surface to have a plurality of regions where the surface shapes are different from one another. The fourth embodiment will now be explained in more detail.

Figure 21:
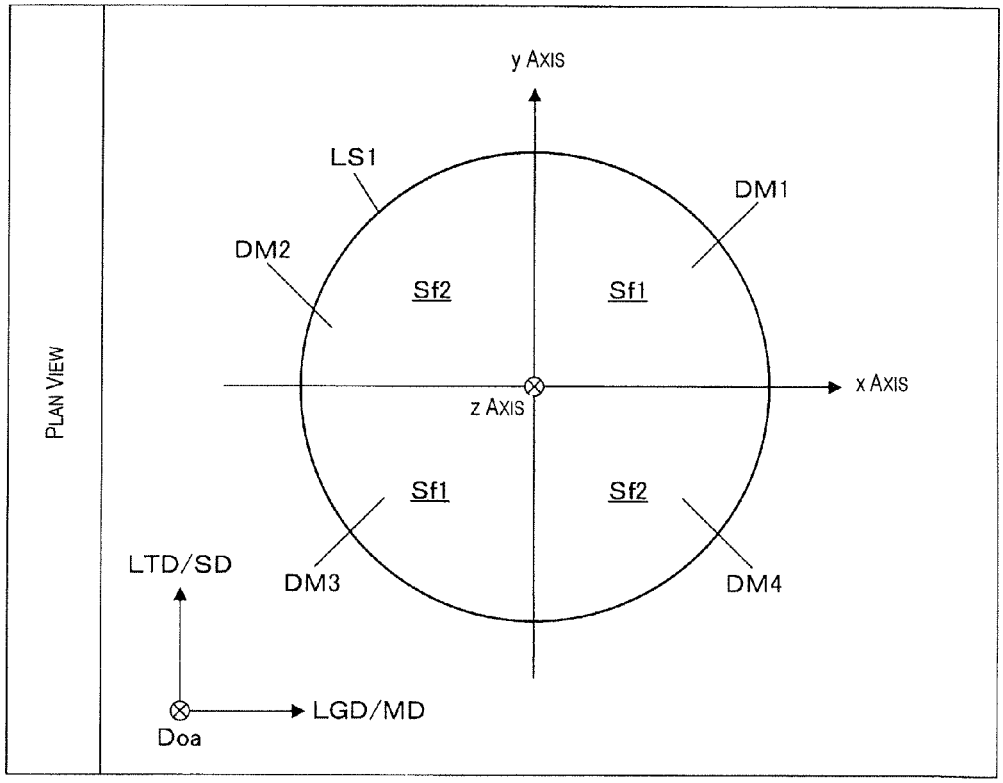
FIG. 21 is simple plan view showing a lens LS1 viewed along an optical axis direction.
Figure 22:
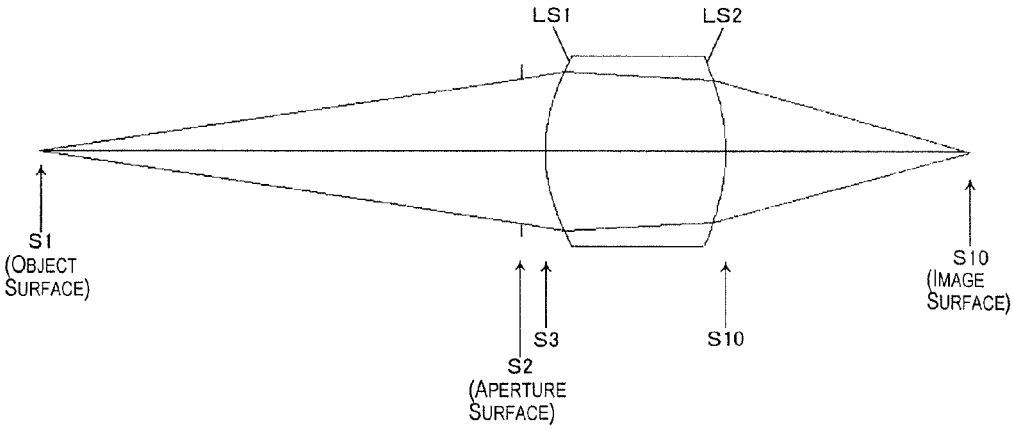
FIG. 22 is a ray diagram of an imaging optical system in a cross section viewed along a main scanning direction.

FIG. 21 is simple plan view showing a lens LS1 viewed along an optical axis direction. FIG. 22 is a ray diagram of an imaging optical system in a cross section viewed along a main scanning direction. As shown in FIG. 21, a lens surface of the lens LS1 in this embodiment is divided into four regions DM1, DM2, DM3, and DM4. The regions DM1 to DM4 are arranged side-by-side along a circumferential direction of the lens LS1 and each is generally pie shaped with a center angle of $\pi/2$ radians. The lens shape in the regions DM1 and DM3 is different from the lens shape in the regions DM2 and DM4; more specifically the regions DM1 and DM3 have a shape Sf1 and the regions DM2 and DM4 have the shape Sf2. Thus, the lens LS1 is configured such that regions having the shape Sf1 and regions having the shape Sf2 are arranged alternately along the circumferential direction of the lens LS1. As shown in FIG. 22, in this embodiment the lens LS1 is convex on the object side while the lens LS2 is concave on the object side (convex on the image side). Additionally, a limiting aperture surface S2 is provided between the object surface and the lens LS1.

FIG. 23 lists equations defining a shape of a lens surface based on lens data. The equation 6 serves to establish a correspondence between x-y Cartesian coordinates and polar coordinates. The equation 7 serves to define a shape of the lens surface (x-y polynomial surface) of each of the lenses. FIG. 24 is a table showing a wavelength of light passing through an imaging optical system OS and an effective diameter of the lenses LS1 and LS2. FIG. 25 shows lens data for the imaging optical system OS. In FIG. 25, the reason the surface type of the surface S3 of the lens LS1 is indicated as "region dependent" is that the lens LS1 is divided into four regions DM1 to DM4 and the shape of the surface is different depending on the region. As indicated in FIG. 25, the surface type of the S4 surface, i.e., the surface type of the lens LS2, is conical.

FIG. 26 is a table showing coefficients defining the shape Sf1 of the regions DM1 and DM3 of the lens LS1. FIG. 27 is a table showing coefficients defining the shape Sf2 of the regions DM2 and DM4 of the lens LS1. FIG. 28 is a table of coefficients defining the shape of the lens LS2.

In this embodiment, the regions DM1 and DM3 have a different astigmatism than the regions DM2 and DM4 because the shapes Sf1 and Sf2 are different. As a result of the difference, the long dimensions of the spot diagrams (focal lens) formed by the light passing through the regions DM1 and DM3 are diagonal with respect to the long dimensions of the spot diagrams (focal lens) formed by the light passing through the regions DM2 and DM4. Thus, since the spot ST is formed by combining these spot diagrams, the anisotropy of the spot ST can be alleviated. This result will now be explained in more detail with reference to FIG. 29.

Figure 29:
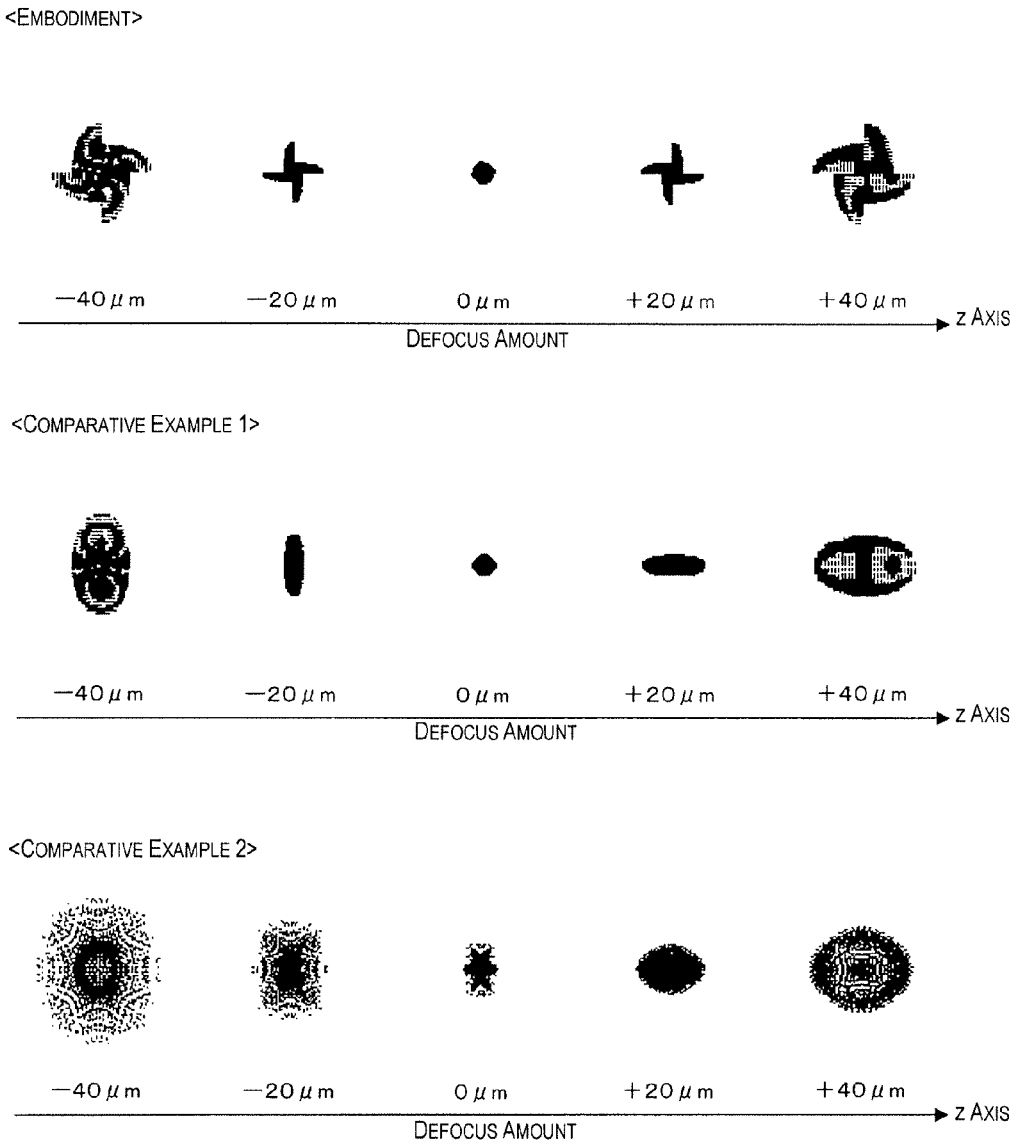
FIG. 29 shows spot diagrams obtained with an embodiment and with first and second comparative examples.

FIG. 29 shows spot diagrams obtained with this embodiment and spot diagrams obtained with first and second comparative examples at different defocus amounts ranging from −40 μm to +40 μm. The spot diagrams titled "embodiment" and shown in an upper portion of the figure are calculated based on the lens data explained previously. The spot diagrams titled "first comparative example" and shown in a middle portion of the figure are calculated using the shape Sf1 for the entire surface of the lens LS1. The spot diagrams titled "comparative example" [sic] and shown in a lower portion of the figure are calculated based on lens data presented in Patent Document 1.

In the first comparative example, the spot ST exhibits vertically elongated anisotropy in a range of negative defocus amounts and horizontally elongated anisotropy in a range of positive defocus amounts. In the second comparative example, too, the spot ST exhibits vertically elongated anisotropy in a range of negative defocus amounts and horizontally elongated anisotropy in a range of positive defocus amounts. Conversely, in the embodiment, the spot ST includes a combination of a plurality of spot diagrams (blur ellipses) arranged such that their long dimensions are diagonal with respect to one another. As a result, as can be observed in the figure, the anisotropy occurring in a defocused state is alleviated.

Other

In the embodiments explained heretofore, the line head 29 corresponds to the "exposure head" mentioned in the invention and the photoreceptor drum 21 corresponds to the "latent image carrier" mentioned in the claims. The lens LS1 corresponds to the "lens" mentioned in the claims. The regions DM1 and DM3 correspond to the "first region" mentioned in the claims, and the regions DM2 and DM4 correspond to the "second region" mentioned in the claims.

The invention is not limited to the previously explained embodiments and various modifications can be made to the previously explained embodiments without departing from the scope defined by the claims. For example, in the embodiments, the imaging optical system OS includes two lines LS1 and LS2. However, the invention is not limited to an imaging optical system having two lenses and it is acceptable for the imaging optical system to have one lens or three or more lenses.

Although the second embodiment uses a cosine function as the function $f(\theta)$, the invention is not limited to using a cosine function and the function $f(\theta)$ can be any of various other functions having an angle $\theta$ as a variable. Examples of functions that can be used include the sine function and other trigonometric functions as well as other periodic functions having an angle $\theta$ as a variable. It is also possible to use a function that is not periodic with respect to the angle $\theta$.

In the second embodiment explained previously, the radius of curvature of the lens LS1 varies according to the angle $\theta$. However, it is also acceptable if another lens in the imaging optical system OS is configured such that its radius of curvature varies according to the angle $\theta$.

Figure 30:
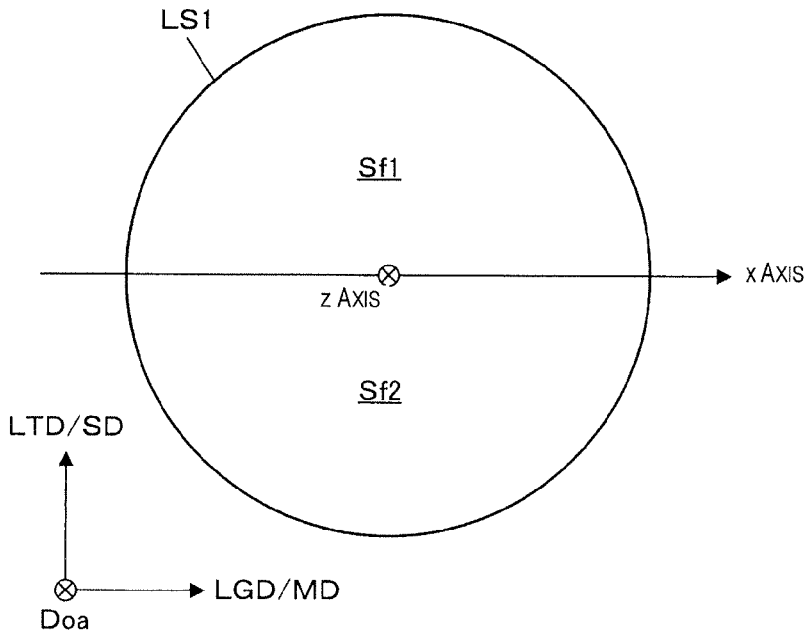
FIG. 30 is simple plan view showing a lens LS1 viewed along an optical axis direction.
Figure 31:
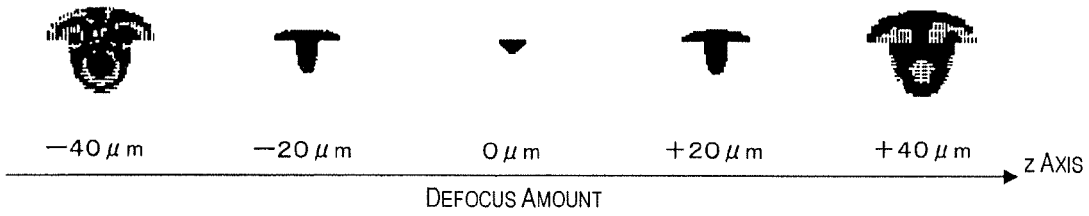
FIG. 31 shows spot diagrams obtained with a variation of an embodiment.

Although in the fourth embodiment the lens LS1 is divided into four regions, the invention is not limited to dividing the lens LS1 into this number of regions. For example, it is also acceptable to configure the lens LS1 to have to regions having different shapes from each other. FIG. 30 is simple plan view showing a variation of the lens LS1 viewed along an optical axis direction. FIG. 31 shows spot diagrams obtained with the variation. As shown in FIG. 30, the lens surface of the lens LS1 according to this variation includes two regions, one having a shape Sf1 and one having a shape Sf2, and each of the regions is generally semicircular with a center angle of $\pi$ radians.

In both the fourth embodiment and the variation, the lens LS1 has a plurality of regions with different shapes. It is also acceptable to configure the other lens(es) of the imaging optical system OS to have a plurality of regions having different shapes.

The positional arrangement of the imaging optical systems OSa, OSb, and OSc with respect to the photoreceptor drum 21 is not limited to the arrangement shown in FIG. 6. For example, the arrangement can be contrived such that the optical axes of the imaging optical systems OSa or the optical axes of the imaging optical systems OSc pass through the center of curvature C21 or such that the none of the optical axes OA of the imaging optical systems OSa, OSb, and OSc pass through the center of curvature C21.

The number of imaging optical systems OS arranged along the subordinate scanning direction (i.e., the number of lens rows) is not limited to three. For example, it is acceptable to have two or four or more lens rows.

In the previously explained embodiments, there is no particular mention of the optical magnification of the imaging optical systems OS. Nevertheless, the optical characteristics of the imaging optical systems OS can be contrived to produce an inverted image, an erect image, a reduced image, an enlarged image, or a combination of these.

Various changes can also be made to the number and arrangement pattern of the light emitting elements E in the light emitting element groups EG.

Other than organic EL elements, LEDs (light emitting diodes) and other light sources can be use as the light emitting elements E.

What is claimed is:

1. An exposure head, comprising:

a light emitting element that emits light;

an imaging optical system having a first region and a second region, a first spot diagram being formed on a plain by the light emitted from the light emitting element that passes through the first region, the first spot diagram having a first long dimension, a second spot diagram being formed on the plain by the light emitted from the light emitting element that passes through the second region, the second spot diagram having a second long dimension, the first long dimension making an angle with the second long dimension.

2. The exposure head according to claim 1, wherein the first long dimension is perpendicular to the second long dimension.

3. The exposure head according to claim 1, wherein the imaging optical system has a lens in which the first region and the second region are arranged along a circumferential direction.

4. An exposure head, comprising:

a light emitting element that emits light; and an imaging optical system having a lens and a substrate on which the lens is arranged, a radius of curvature R of the lens being given by the following relationship:

$$R=J+L\times\cos(M\times\theta),$$

where a Z axis is defined to be an imaginary axis that is parallel to a normal direction of the substrate and passes through a centroid of a projection of the lens projected onto the substrate along a normal direction of the substrate, an X axis is defined to be an imaginary axis that is perpendicular to the Z axis and passes through the centroid of the lens, J is a constant, L is a constant, M is a positive integer, and θ is a rotational angle with respect to the X axis measured in a counterclockwise direction about the Z axis, and the imaging optical system focuses light emitted from the light emitting element and forms a spot diagram having a first long dimension and a spot diagram having a second long dimension with a different slope to the first long dimension.

5. An image forming apparatus, comprising:

an exposure head including a light emitting element and an imaging optical system having a first region and a second region; and a latent image carrier on which a latent image is formed by light that has passed through the imaging optical system; wherein a first spot diagram being formed on a plain by the light emitted from the light emitting element that passes through the first region, the first spot diagram having a first long dimension a second spot diagram being formed on the plain by the light emitted from the light emitting element that passes through the second region, the second spot diagram having a second long dimension.

* * * * *